US007210990B2

(12) United States Patent
Buchmann et al.

(10) Patent No.: US 7,210,990 B2
(45) Date of Patent: May 1, 2007

(54) TREATMENT APPARATUS FOR TREATING WORKPIECES OR GROUPS OF WORKPIECES

(75) Inventors: Richard Buchmann, Bad Überkingen (DE); Andreas Metzger, Filderstadt (DE)

(73) Assignee: Durr Ecoclean GmbH, Filderstadt (DE)

( * ) Notice: Subject to any disclaimer, the term of this patent is extended or adjusted under 35 U.S.C. 154(b) by 0 days.

(21) Appl. No.: 11/092,458

(22) Filed: Mar. 29, 2005

(65) Prior Publication Data

US 2005/0239011 A1 Oct. 27, 2005

(30) Foreign Application Priority Data

Mar. 30, 2004 (DE) ..... 10 2004 015 325

(51) Int. Cl.
*B24B 31/00* (2006.01)

(52) U.S. Cl. ..... 451/104; 451/64; 451/80; 451/402; 451/403; 414/153; 414/180; 414/187; 414/223

(58) Field of Classification Search ..... 451/64, 451/80, 402, 403; 414/153, 180, 187, 223
See application file for complete search history.

(56) References Cited

U.S. PATENT DOCUMENTS 4,022,570 A 5/1977 Ross, Jr. et al.
4,986,750 A * 1/1991 Sakamoto ..... 432/131
5,997,290 A * 12/1999 Hillingrathner ..... 432/124

FOREIGN PATENT DOCUMENTS

| | | |
|---|---|---|
| DE | 44 42 152 A1 | 5/1996 |
| DE | 196 35 257 C1 | 3/1998 |
| DE | 196 38 106 C1 | 4/1998 |
| DE | 196 39 933 C1 | 4/1998 |
| DE | 199 28 990 C2 | 1/2001 |
| EP | 0 178 182 B1 | 4/1986 |
| EP | 0 345 026 B1 | 12/1989 |
| GB | 908765 | 10/1962 |

* cited by examiner

*Primary Examiner*—Lee D. Wilson
*Assistant Examiner*—Shantese McDonald
(74) *Attorney, Agent, or Firm*—Leydig, Voit & Mayer, Ltd.

(57) ABSTRACT

In order to provide a treatment apparatus for treating workpieces or groups of workpieces that are conveyed from an inlet to an outlet of the treatment apparatus, wherein the treatment apparatus comprises a plurality of treatment levels and with said treatment apparatus the workpieces to be treated are passed from level to level in a safe and controlled manner, it is proposed that the treatment apparatus comprises a housing and receiving chambers, which rotate relative to the housing, for receiving the workpieces or groups of workpieces, wherein the receiving chambers are disposed in at least two different chamber levels and an outlet opening in the housing is associated with a first chamber level, through which the workpieces or groups of workpieces travel first, and an inlet opening is associated with a second chamber level, through which the workpieces or groups of workpieces travel after the first chamber level, and wherein the treatment apparatus comprises at least one transfer apparatus, which moves the workpieces or groups of workpieces from the outlet opening to the inlet opening.

47 Claims, 15 Drawing Sheets

255
118
114
118
232
226
120
178
228
230
102
234
234
108
242
236
242
126
228
178
238
240
116
120
106

255
118
114
118
244
120
178
126
102
108
248
250
250
246
178
120
254
252
106

TREATMENT APPARATUS FOR TREATING WORKPIECES OR GROUPS OF WORKPIECES

RELATED APPLICATION

The present disclosure refers to the subject matter that was disclosed in German patent application No. 10 2004 015 5.6 of 30 Mar. 2004. The entire description of this earlier application is incorporated by reference in the present description ("incorporation by reference").

FIELD OF THE DISCLOSURE

The present invention relates to a treatment apparatus for treating workpieces or groups of workpieces that are conveyed from an inlet to an outlet of the treatment apparatus.

BACKGROUND

Such an apparatus is known, for example, from DE 44 42 152 A1.

In the treatment apparatus known from DE 44 42 152 A1, the parts to be treated are fed to so-called "virtual chambers" and in these virtual chambers are conveyed through processing treatments. This treatment apparatus comprises a plurality of circular bases disposed with spacing one above the other, which are enclosed by a wall cylinder and between which there is in each case a system of blades disposed at uniform angular intervals. The blade systems rotate jointly relative to the bases, wherein each base has a window and the windows of successive bases in the direction of passage of the workpieces are disposed offset relative to one another counter to the direction of rotation of the blade systems so that the workpieces, which are fed in each case into a "virtual chamber" delimited by two blades, complete in each case a partial circuit along the bases to the window of the relevant base and, there, then fall onto the base situated underneath, where they then complete the next partial circuit. The chambers in this apparatus are described as "virtual" because in the course of conveying the workpiece they continuously exchange their real bottom and top walls.

The treatment apparatus known from DE 44 42 152 A1 is provided for the processing treatment of small workpieces, which are not damaged by the drop through a base window from one level to the next level of the treatment apparatus.

Particularly in the case of heavier workpieces having a surface that should not be damaged, an uncontrolled drop from one level to another level of the treatment apparatus does however present a considerable risk.

SUMMARY OF THE INVENTION

The underlying object of the present invention is to provide a treatment apparatus for treating workpieces or groups of workpieces that are conveyed from an inlet to an outlet of the treatment apparatus, wherein the treatment apparatus comprises a plurality of treatment levels and in the treatment apparatus the workpieces to be treated are passed from level to level in a safe and controlled manner.

According to the invention this object is achieved by means of a treatment apparatus, which comprises a housing and receiving chambers, which rotate relative to the housing, for receiving the workpieces or groups of workpieces, wherein the receiving chambers are disposed in at least two different chamber levels and an outlet opening in the housing is associated with a first chamber level, through which the workpieces or groups of workpieces travel first, and an inlet opening is associated with a second chamber level, through which the workpieces or groups of workpieces travel after the first chamber level, and wherein the treatment apparatus comprises at least one transfer apparatus, which moves the workpieces or groups of workpieces from the outlet opening to the inlet opening.

The treatment apparatus according to the invention makes it possible for even heavy workpieces with a sensitive surface to be moved in a controlled, damage-free manner within the levels of the treatment apparatus and during the transfer from one level to the next level.

At the same time, the advantages of the treatment apparatus known from DE 44 42 152 A1 are retained.

In particular, workpieces that are fed singly to the treatment apparatus remain single in the treatment apparatus and are discharged in the same time cycle.

The treatment apparatus according to the invention is comparable to a rectilinear throughfeed system, which has been wound up, and therefore has only a small footprint.

In a preferred development of the treatment apparatus according to the invention, it is provided that the workpieces or groups of workpieces are movable by means of the transfer apparatus in a defined spatial position from the outlet opening to the inlet opening.

It is moreover preferably provided that the workpieces or groups of workpieces in the first chamber level and/or in the second chamber level are moved through an angle of at least approximately 90°, preferably of at least approximately 180°, in particular of at least approximately 270°, about an axis of rotation of the treatment apparatus.

The workpieces or groups of workpieces in the first chamber level and/or in the second chamber level are moreover moved preferably through an angle of less than 360° about an axis of rotation of the treatment apparatus.

Preferably, all of the receiving chambers of the same chamber level rotate synchronously with one another.

In particular, it may be provided that all of the receiving chambers of the same chamber level are rigidly connected to one another.

It is further advantageous when at least two receiving chambers of different chamber levels rotate synchronously with one another.

In particular, it may be provided that at least two receiving chambers of different chamber levels are rigidly connected to one another.

In a preferred development of the treatment apparatus according to the invention, it is provided that all of the receiving chambers of all of the chamber levels rotate synchronously with one another.

In particular, it may be provided that all of the receiving chambers of all of the chamber levels are rigidly connected to one another.

The receiving chambers of the treatment apparatus may in particular be formed in that the treatment apparatus comprises a, preferably substantially cylindrical, chamber drum, which is rotatable about an axis of rotation of the chamber drum and comprises at least one bottom wall, which is constructed transversely of the axis of rotation, and at least two dividing walls, which are oriented transversely of the bottom wall.

In particular, it may be provided that the chamber drum comprises at least two bottom walls and at least one top wall, which is oriented transversely of the axis of rotation.

In order to separate the receiving chambers formed in the chamber drum in a fluid-tight manner from one another and from the environment of the receiving chambers, it is advantageously provided that the chamber drum is provided at its periphery with a surface seal. This allows the workpieces in the receiving chambers to be subjected to a treatment using a liquid or gaseous treatment medium.

Through the use of such a seal it is moreover possible to design at least one chamber level of the treatment apparatus as a lock, in which the workpieces are adapted in stages from an initial state to a new ambient state. The period of adaptation to the new ambient state may in this case be considerably longer than the time cycle, in which the workpieces or groups of workpieces fed to the treatment apparatus succeed one another.

The region of the treatment apparatus that has a lock function may extend over a plurality of levels of the treatment apparatus.

If the workpiece progression cycle is, for example, ten workpieces per second and the treatment apparatus comprises, for example, ten receiving chambers per level, then the speed of rotation of the receiving chambers is one revolution per second. If the lock region extends over three levels of such a treatment apparatus, then for the inward transfer operation approximately three seconds are available, this corresponding to 30 times the workpiece progression cycle.

The material of the surface seal preferably comprises a plastics material of low sliding friction, e.g. polyethylene.

The material of the surface seal may further comprise a fluoropolymer or a fluoropolymer compound, since these substances have a high chemical resistance and low friction.

Here, by a fluoropolymer compound in this description and in the accompanying claims is meant a mixture of at least one fluoropolymer and at least one organic or inorganic filler. Suitable examples of such fillers are, in particular, graphite, carbon, carbon fibres, bronze, molybdenum disulphide or organic fillers, in particular high-temperature-resistant thermoplastic materials and thermoset materials, e.g. polyamide.

As a fluoropolymer, polytetrafluoroethylene (PTFE) or a modified polytetrafluoroethylene is preferably used. Here, by a "modified polytetrafluoroethylene" is meant a substance, which is similar to PTFE and in which the molecular structure of the PTFE has been chemically modified by partially replacing the fluorine atoms of the PTFE with substituents.

So that differences in the thermal expansion of the material of the surface seal, on the one hand, and of the material of other components of the treatment apparatus, on the other hand, may be reduced or fully compensated, the surface seal is preferably provided with compensating recesses, wherein the compensating recesses comprise in each case at least one compensating region, which varies in width upon a change of temperature of the surface seal and/or upon loading of the surface seal with a mechanical stress.

This makes it possible to use the surface seal in a wide temperature range without any risk of fatigue.

In a preferred development of the surface seal, it is provided that at least some of the compensating recesses comprise in each case at least one compensating region, which has a longitudinal direction oriented transversely of, preferably substantially at right angles to, the peripheral direction of the chamber drum.

Alternatively or in addition thereto, it may be provided that at least some of the compensating recesses comprise in each case at least one compensating region, which has a longitudinal direction aligned substantially parallel to the peripheral direction of the chamber drum.

It is preferably provided that at least some of the compensating recesses comprise in each case at least two compensating regions.

In said case, it is particularly advantageous when in each case at least two compensating regions of a compensating recess have longitudinal directions oriented transversely of, preferably substantially at right angles to, one another. This allows differences of thermal expansion to be compensated both in the peripheral direction and in the axial direction of the chamber drum.

In a preferred development of the treatment apparatus according to the invention, it is provided that the compensating recesses of the surface seal comprise in each case at least one compensating region, which in the mounted state of the surface seal varies in width upon a change of the temperature of the surface seal in such a way that the difference between the thermal expansion of the surface seal and of the chamber drum is at least partially, preferably substantially fully, compensated.

It has moreover proved advantageous when at least some of the compensating recesses comprise a central region, into which open at least two compensating regions of the compensating recess open.

These two compensating regions that open into the central region of the same compensating recess advantageously have longitudinal directions oriented transversely of, preferably substantially at right angles to, one another.

So that the workpieces may be introduced into and removed from the receiving chambers of the chamber drum, the surface seal, in addition to the compensating recesses, advantageously has access openings, which in the mounted state of the surface seal afford access to receiving chambers of the chamber drum.

When the surface seal comprises webs, which separate these access openings from one another, at least some of the compensating recesses of the surface seal are preferably disposed in intersection regions of the webs.

In a preferred development of the treatment apparatus according to the invention, it is provided that the surface seal in the mounted state encircles the chamber drum.

It is particularly advantageous for the surface seal to be of an integral construction. Such an integral surface seal is particularly easy and time-saving to manufacture and mount and/or exchange, should maintenance be required.

The possibility of being able to seal off the receiving chambers from one another and from the environment by means of a single surface seal that embraces the chamber drum is a central advantage of the treatment apparatus according to the invention over the treatment apparatus known from DE 44 42 152 A1, in which the blades have to move relative to the bases of the treatment apparatus and it is therefore necessary additionally to provide a seal in each case for the upper edge and the bottom edge of each blade.

In the treatment apparatus according to the invention there is moreover no need to seal off the receiving chambers from a central rotary shaft of the treatment apparatus because the receiving chambers move together with the central torque shaft of the treatment apparatus.

The outer surface of the, preferably cylindrical, chamber drum is easy to machine.

The surface seal disposed on this peripheral surface of the chamber drum is readily accessible and easy to exchange.

To make maintenance of the treatment apparatus particularly simple, it is preferably provided that the receiving chambers are removable from the housing.

It is particularly advantageous when a plurality of receiving chambers form component parts of a chamber drum, which is removable as a whole from the housing.

So that the workpieces may rotate inside the respective receiving chamber during a processing treatment, in a preferred development of the treatment apparatus it is provided that at least one of the receiving chambers is provided with a workpiece support, by means of which the workpiece inside the receiving chamber is rotatable relative to the receiving chamber.

In particular, it may be provided that the workpiece is rotatable by means of the workpiece support about an axis of rotation that is aligned substantially parallel to the axis of rotation of the receiving chambers of the treatment apparatus.

As an alternative thereto, it may be provided that the workpiece is rotatable by means of the workpiece support about an axis of rotation that is oriented transversely of, preferably substantially at right angles to, the axis of rotation of the receiving chambers of the treatment apparatus.

There are many possible ways of setting the workpiece in rotation inside the receiving chamber.

For example, it may be provided that at least one of the receiving chambers is provided with a turning apparatus, which comprises means of picking off a rotational movement from an inner wall of the housing of the treatment apparatus.

Alternatively or in addition thereto, it may be provided that at least one of the receiving chambers is provided with a turning apparatus, which comprises a rotary shaft extending through a wail of the receiving chamber.

In order to be able to carry out a subsequent processing treatment of the workpieces in vacuo, it is advantageous when at least one chamber level of the treatment apparatus is designed as a vacuum lock.

It is particularly advantageous when the receiving chambers of the chamber level designed as a vacuum lock in the course of their movement from an inlet opening of said chamber level to an outlet opening of said chamber level are evacuated in a plurality of discrete stages.

By virtue of the multi-stage evacuation, a period that is extended compared to the workpiece progression time is available for creating the vacuum in each receiving chamber. Furthermore, the pressure difference and hence the leakage rate across the chamber seal are reduced by virtue of the multi-stage evacuation.

It is further advantageous when the receiving chambers of the chamber level designed as a vacuum lock in the course of their movement from an outlet opening of said chamber level to an inlet opening of said chamber level are aerated in a plurality of discrete stages.

It has further proved advantageous when in each case at least one of the receiving chambers of the chamber level designed as a vacuum lock that is on the way from the inlet opening of said chamber level to the outlet opening of said chamber level is connected in terms of gas to, in each case, one other receiving chamber of said chamber level that is on the way from the outlet opening of said chamber level to the inlet opening of said chamber level. This produces a gas short circuit between a not yet fully evacuated receiving chamber, which is on the way from the inlet opening to the outlet opening, and a not yet fully aerated receiving chamber, which is on hes way from the outlet opening back to the inlet opening. By virtue of such a gas short circuit some of the evacuation of the receiving chamber is already achieved without using a vacuum pump, so that the vacuum pump has to evacuate each receiving chamber only from an already reduced chamber pressure to the desired vacuum ultimate pressure. Furthermore, in this way the gas quantity that has to be pumped out of the receiving chambers by means of a vacuum pump is markedly reduced.

Further features and advantages of the invention are the subject matter of the following description and the graphic representation of embodiments.

BRIEF DESCRIPTION OF THE DRAWINGS

Identical or functionally equivalent elements are denoted in all of the drawings by the same reference characters.

DETAILED DESCRIPTION OF THE INVENTION

Figure 1:
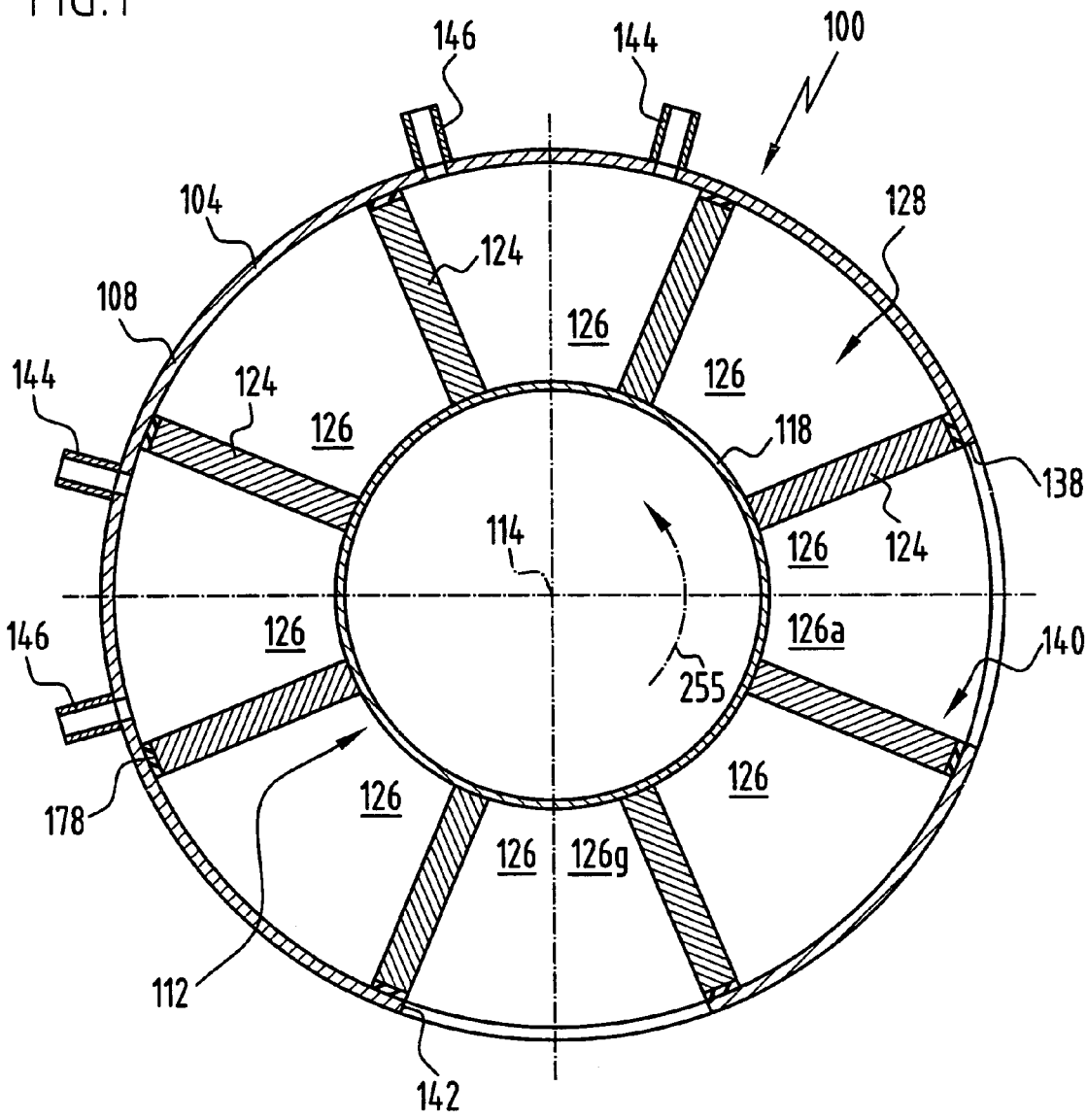
FIG. 1 a diagrammatic horizontal cross section through a treatment apparatus.
Figure 2:
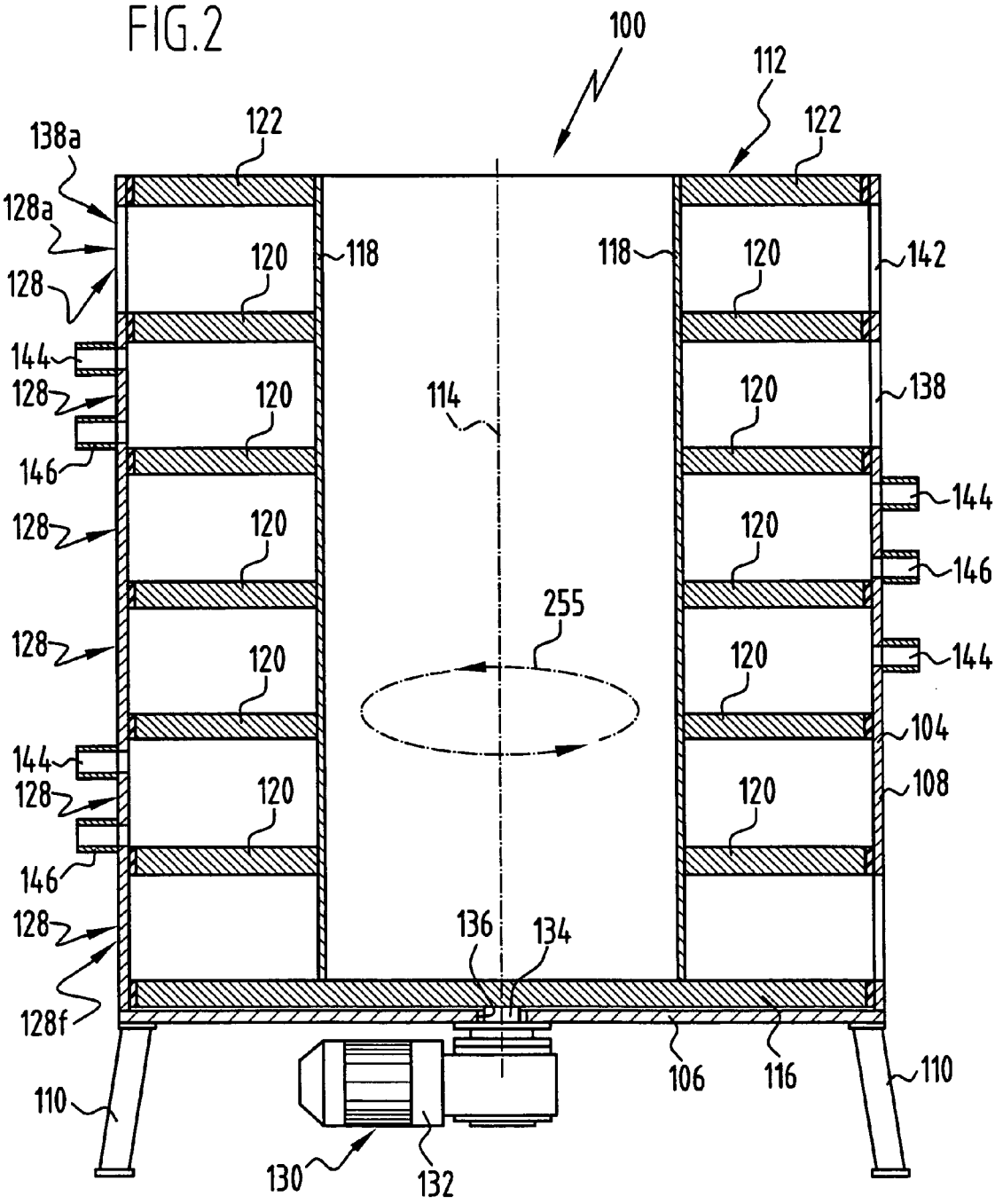
FIG. 2 a diagrammatic vertical longitudinal section through the treatment apparatus of FIG. 1.

A treatment apparatus for the processing treatment of workpieces 102, which is illustrated in FIGS. 1 to 8 and denoted as a whole by 100, comprises a housing 104 having a circular disk-shaped base plate 106 and a hollow-cylindrical housing wall 108, which extends in an upward direction from the upper side of the base plate 106 (see FIG. 2).

The base plate 106 of the housing 104 rests on a plurality of posts 110, which are supported on a subsurface (not shown).

In an upward direction the housing 104 is open.

Disposed in the interior of the housing 104 is a chamber drum denoted as a whole by 112, which is rotatable about a substantially vertical axis of rotation 114.

The chamber drum 112 at its bottom end comprises a circular disk-shaped drum base plate 116, from the upper side of which a hollow-cylindrical hollow shaft 118 aligned coaxially with the drum base plate 116 extends in an upward direction.

The combined height of the drum base plate 116 and the hollow shaft 118 corresponds substantially to the height of the housing wall 108.

From the outside of the hollow shaft 118 a plurality of annular disk-shaped base plates 120 and an annular disk-shaped top plate 122, which is disposed on the top end of the hollow shaft 118, extend outwards in radial and horizontal direction, wherein the base plates 120 are spaced apart in axial direction of the hollow shaft 118 from one another, from the drum base plate 116 and/or from the top plate 122.

As may be seen from FIG. 1, vertical dividing walls 124 moreover extend outwards in radial direction from the outside of the hollow shaft 118, wherein each of the dividing walls 124 is disposed in each case between two base plates 120, between a base plate 120 and the drum base plate 116 or between a base plate 120 and the top plate 122.

In each case, two vertical dividing walls 124, a portion of the hollow shaft 118, and two base plates 120 or one base plate 120 and the drum base plate 116 or one base plate 120 and the top plate 122 delimit a receiving chamber 126 of the chamber drum 112.

The receiving chambers 126 that are disposed at the same height in the chamber drum 112 together form a chamber level 128 of the chamber drum 112.

The treatment apparatus 100 illustrated by way of example therefore comprises a chamber drum 112 having six chamber levels 128, each of which comprises eight receiving chambers 126.

The number of receiving chambers 126 need not however be the same in every chamber level 128; rather, the number of receiving chambers per chamber level 128 may vary in any desired manner.

In particular, it may be provided that in one or more chamber levels one or more of the dividing walls 124 between successive receiving chambers 126 are omitted.

All of the receiving chambers 126 of the same chamber level 128 and the receiving chambers of different chamber levels 128 are connected to one another in a rotationally fixed manner so that they are rotatable jointly about the axis of rotation 114 of the chamber drum 112.

For entrainment this turning apparatus, a rotary drive denoted as a whole by 130 is used, which comprises a rotary drive motor 132, e.g. an electric geared motor, which is disposed on the underside of the base plate 106 of the housing 104.

The output shaft 134 of the rotary drive motor 132 extends through a central through-opening 136 in the base plate 106 of the housing 104 and is connected in a rotationally fixed manner to the underside of the drum base plate 116 of the chamber drum 112.

So that workpieces 102 may be introduced into the treatment apparatus 100, the housing wall 108 is provided at the height of the uppermost chamber level 128*a* with an, e.g. four-cornered, inlet opening 138*a*. The extent of the inlet opening 138*a* corresponds substantially to the extent of the mouth opening 140—delimited by the vertical dividing walls 124, the base plate 120 and the top plate 122—of each of the receiving chambers 126 of the uppermost chamber level 128*a*, so that the receiving chambers 126 of the uppermost chamber level 128*a* may be brought alternately into a loading position, in which the mouth opening 140 of the respective receiving chamber 126 is aligned with the inlet opening 138*a* in the housing wall 108, as is shown in FIG. 1 for the chamber 126*a*.

After a workpiece 102 to be treated has been introduced through the inlet opening 138 into the receiving chamber 126 aligned in each case with the inlet opening 138, the relevant receiving chamber 126 with the workpiece 102 disposed therein is rotated by the rotational movement of the chamber drum 112—continuously or cyclically—through an angle of rotation of less than 360° about the axis of rotation 114 into a transfer position, in which the mouth opening 140 of the relevant receiving chamber 126 is aligned with an outlet opening 142, which is disposed in the housing wall 108 likewise at the height of the uppermost chamber level 128*a*. In FIG. 1, the receiving chamber 126*g* has just reached this transfer position.

Preferably, the angular distance between the outlet opening 142 and the inlet opening 138 of a chamber level 128 corresponds to the angle at circumference, over which one of the receiving chambers 126 or a plurality of receiving chambers 126 of the relevant chamber level 128 extends.

On the way between the inlet opening 138 and the outlet opening 142 the workpiece 102 disposed in the receiving chamber 126 may be subjected to any desired processing treatment.

These processing treatments may be, for example, heat treatments, in particular annealing treatments, such as e.g. the "soft annealing" of tubes, or drying treatments, such as e.g. the drying of an enamel coating of the workpiece 102.

Other processing treatments may be, for example, sandblasting of a workpiece 102 or vapour coating of a workpiece 102.

Other possible treatments of a workpiece 102 are, for example, washing treatments with aqueous or hydrocarbon liquids and/or treatments that have to be carried out under gas protection or in vacuo.

On each chamber level 128, the workpiece 102 may be subjected to one or more of such processing treatment steps.

If a treatment medium for such a treatment is to be fed to the receiving chamber 126, this occurs through feed connecting pieces 144, which are disposed on the housing wall 108 at the angular position that is passed by the receiving chamber 126 at the desired treatment time. For removing a treatment medium from a receiving chamber 126, discharge connecting pieces 146 are provided on the housing wall 108 and are offset relative to the respective associated feed connecting piece 144 by an angle of rotation that corresponds to the desired treatment period.

The discharge connecting piece 146 for a treatment medium however need not necessarily be situated at the same level as the feed connecting piece 144 for the same treatment medium. Rather, it may be provided that a treatment medium fed at one level of the treatment apparatus 100 is only discharged at a directly or indirectly succeeding level.

Figure 3:
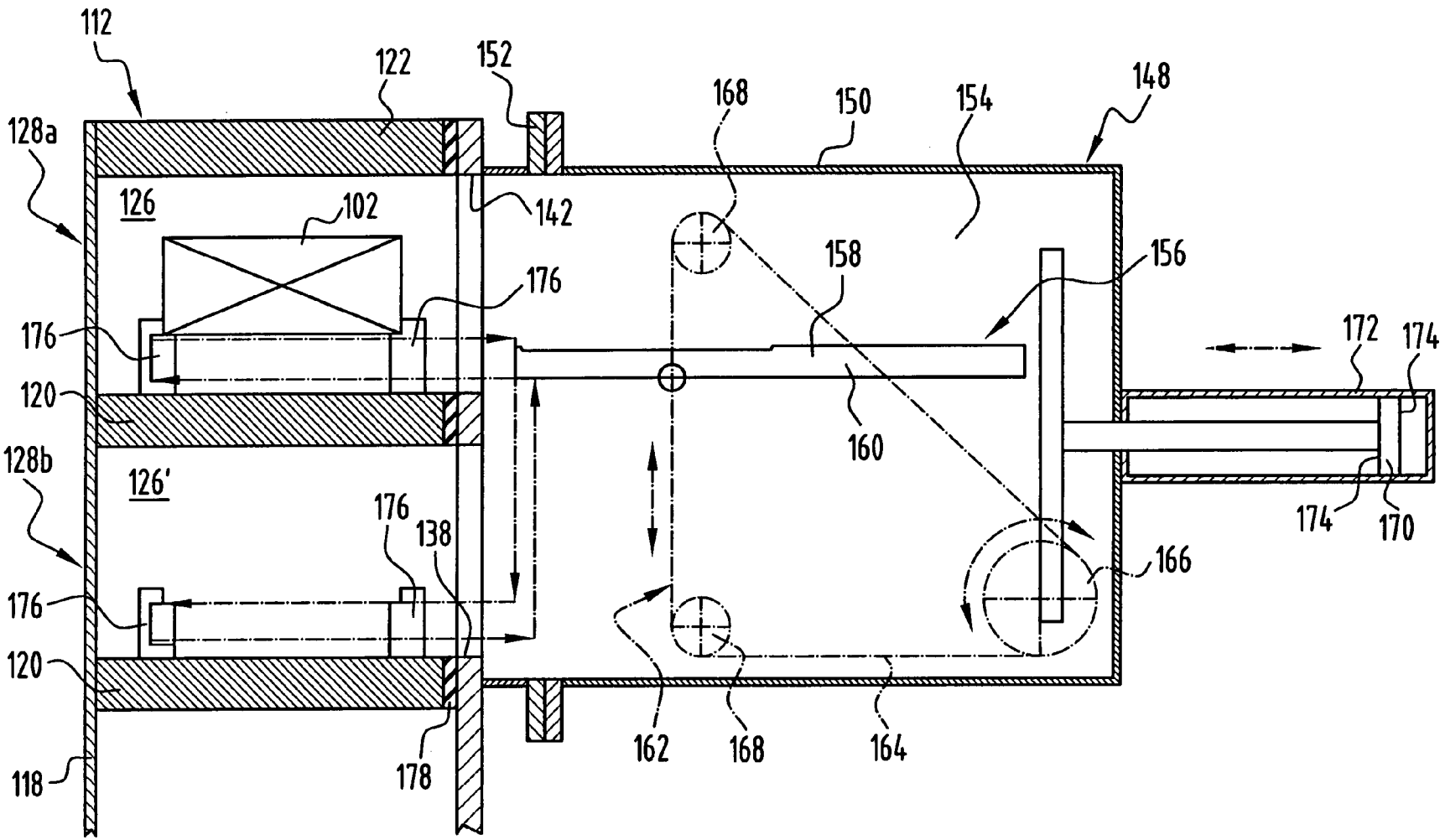
FIG. 3 a diagrammatic view of a transfer apparatus for transferring workpieces between two chamber levels of the treatment apparatus.

So that a workpiece 102 after passing through one level 128 of the treatment apparatus 100 may be transferred to a succeeding treatment level, the treatment apparatus 100 comprises a plurality of transfer apparatuses 148, one of which is diagrammatically illustrated in FIG. 3.

The transfer apparatus 148 comprises a housing 150, which is flange-mounted in a fluid-tight manner onto a fastening flange 152 of the housing 104 of the treatment apparatus 100.

The fastening flange 152 surrounds a region of the housing wall 108 that surrounds the outlet opening 142 of a first chamber level 128*a* and an inlet opening 138 of a second chamber level 128*b*, with the result that the fastening flange 152, the housing 150 of the transfer apparatus 148 and the housing wall 108 of the treatment apparatus 100 form a closed chamber 154, which connects the outlet opening 142 in a fluid-tight manner to the inlet opening 138.

The transfer apparatus 148 further comprises a moving apparatus 156 for the workpiece 102, which moving apparatus is disposed inside the chamber 154.

The moving apparatus 156 comprises a movable workpiece receiver 158, e.g. in the form of a movable fork 160, which is displaceable in vertical direction by means of a chain hoist 162.

The chain hoist 162 comprises e.g. a pull chain 164, which is run via a driven chain wheel 166 and two deflection chain wheels 168.

The chain hoist 162 together with the fork 160 is displaceable by means of a pneumatic piston 170 in radial direction of the chamber drum 112.

The pneumatic piston 170 is held displaceably in a pneumatic cylinder 172 and may at its two end faces 174 be loaded alternately with an increased gas pressure in order to move the chain hoist 162 with the fork 160 disposed therein towards the axis of rotation 114 of the chamber drum 112 or away from the axis of rotation 114.

The workpiece 102 that is to be transferred from the chamber level 128*a* to the chamber level 128*b* rests in the receiving chamber 126 of the chamber level 128*a* on spacers 176, which are supported on the base of the receiving chamber 126.

In order to receive the workpiece 102, the fork 160 is lifted by means of the chain hoist 162 to the height of the chamber level 128*a*.

Then the fork 160 is pushed by means of the pneumatic piston 170 through between the spacers 176 and under the workpiece 102.

The fork 160 is then lifted slightly by means of the chain hoist 162, with the result that the workpiece 102 is supported on the fork 160 and lifted off the spacers 176 of the receiving chamber 126.

The fork 160 plus the workpiece 102 is then removed from the receiving chamber 126 of the chamber level 128*a* by means of the pneumatic piston 170 and lowered to the entry height of the chamber level 128*b* by means of the chain hoist 162.

The fork 160 plus the workpiece 102 is then pushed by means of the pneumatic piston 170 into a receiving chamber 126' of the chamber level 128*b*.

By lowering the fork 160 by means of the chain hoist 162, the workpiece 102 is deposited on the spacers 176 on the base of the receiving chamber 126'.

The pneumatic piston 170 then completely removes the fork 160 from the receiving chamber 126', and the fork 160 is lifted by means of the chain hoist 162 to the level of the chamber level 128*a* in order to await and transfer the next workpiece 102 from the chamber level 128*a*.

As the transfer apparatus 148 is fully enclosed, it is also possible for any treatment medium fed in the chamber level 128*a* to flow through the chamber 154 of the transfer apparatus 148 and on into the chamber level 128*b*.

An equalization of pressure also occurs between the receiving chambers of chamber level 128*a* and chamber level 128*b* so that, in particular, a vacuum created in the chamber level 128*a* is maintained in the chamber level 128*b*.

After the transfer of a workpiece 102 from one chamber level 128*a* to the next chamber level 128*b*, the relevant workpiece 102 is conveyed in the chamber level 128*b* by rotation of the chamber drum 112 through an angle of less than 360° about the axis of rotation 114 to the outlet opening 142 of the chamber level 128*b*.

The workpiece 102, as it travels through this level of the treatment apparatus 100, may be subjected to further processing treatments in the receiving chamber 126'.

On reaching the outlet opening 142 of the chamber level 128*b*, the workpiece 102 by means of a further transfer apparatus 148, which may be of a corresponding design to the previously described transfer apparatus 148, is transferred to the inlet opening 138 of a further chamber level 128 or, if the chamber level 128*b* is the last level to be travelled through by the workpiece 102, is removed from the treatment apparatus 100.

In the previously described embodiment, travel through the levels of the treatment apparatus 100 is effected from top to bottom. It would of course also be equally possible for the workpieces 102 to be introduced first into the lowermost chamber level 128*f*, then conveyed through the treatment apparatus 100 from the bottom up to the uppermost chamber level 128*a* and removed at this level from the treatment apparatus 100.

Particularly if liquid or gaseous treatment media are used in the treatment apparatus 100 and/or if a vacuum is created inside the treatment apparatus 100, a surface seal 178 has to be situated between the outer surface of the chamber drum 112 and the inner surface of the housing wall 108 in order to prevent a liquid or gaseous medium from flowing out of a receiving chamber 126 into vertically or horizontally adjacent receiving chambers 126 or into the environment.

This surface seal 178 is disposed in a rotationally fixed manner on the peripheral surface of the chamber drum 112 and moves together with the chamber drum 112 through the interior of the housing 104 of the treatment apparatus 100.

The surface seal 178 takes the form of an integral wrapping foil seal.

Figure 5:
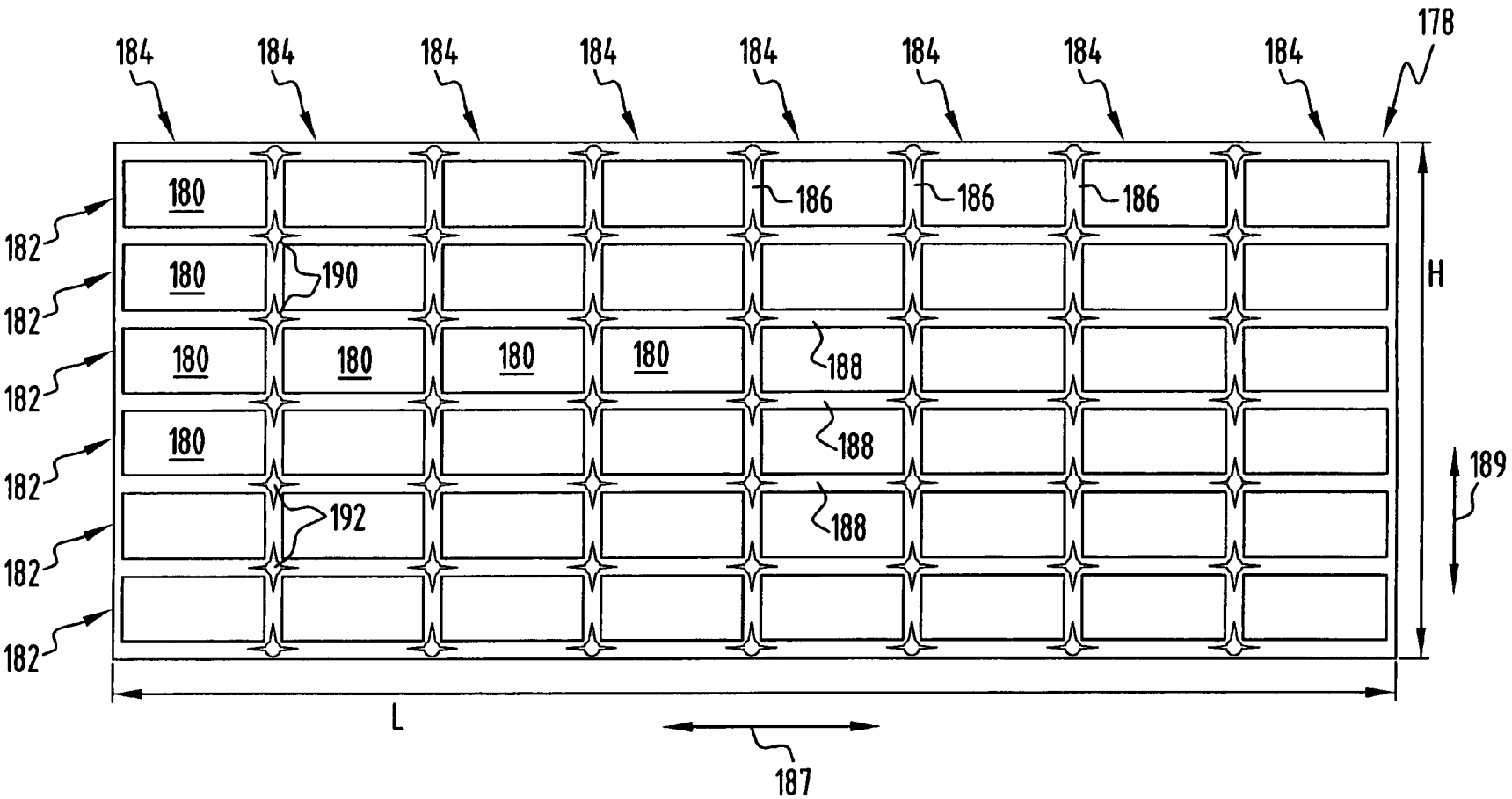
FIG. 5 a diagrammatic developed view of a surface seal of the treatment apparatus in a cold mounted state.

A developed view of the surface seal 178 stretched onto the chamber drum 112 and in a cold mounted state (at room temperature) is illustrated in FIG. 5.

Figure 7:
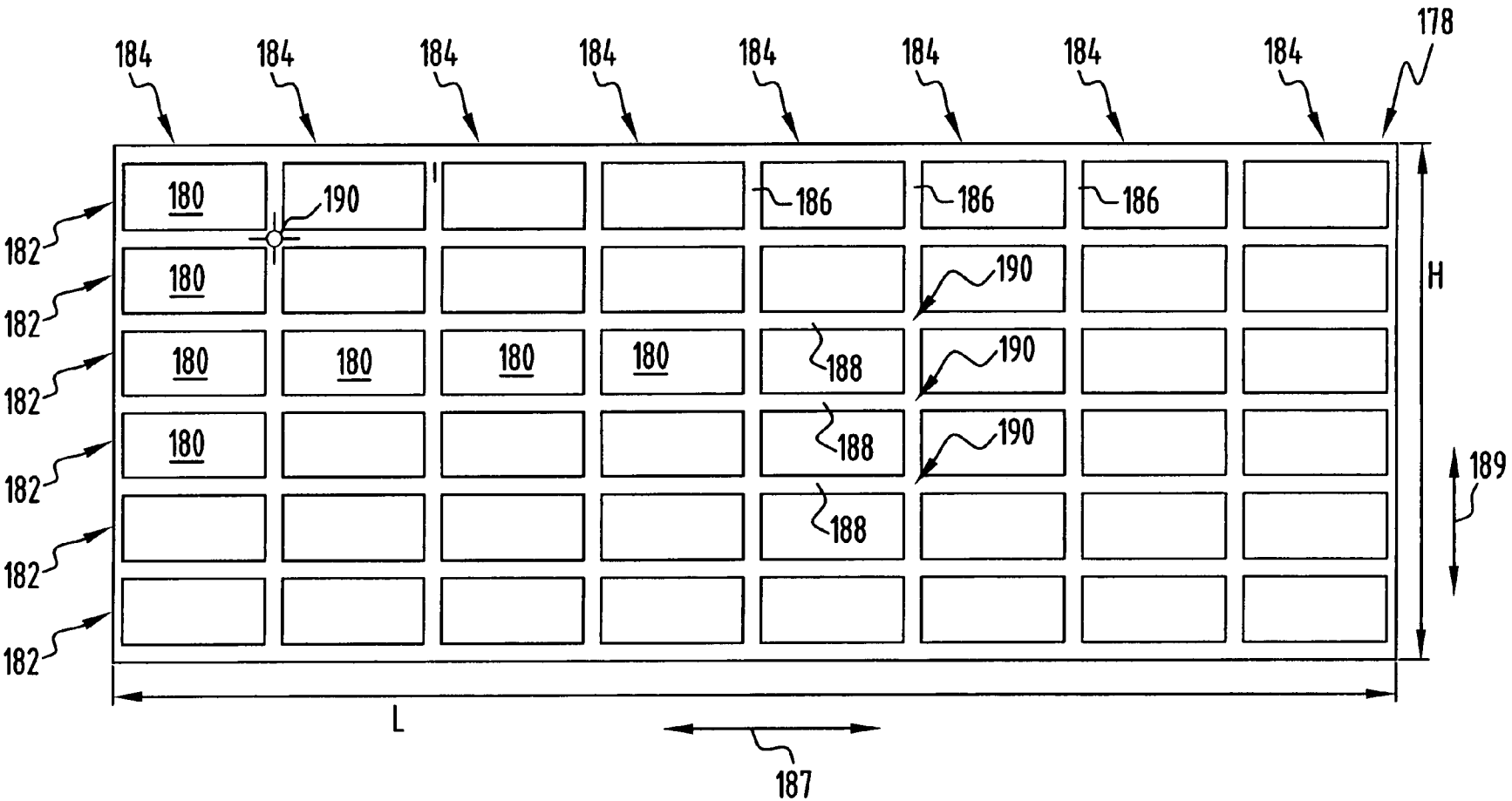
FIG. 7 a diagrammatic developed view of the surface seal of FIG. 5 in a warm operating state.

A developed view of the surface seal 178 in a warm operating state (at an operating temperature of e.g. 120° C.) is illustrated in FIG. 7.

The surface seal 178 is manufactured in the form of a foil from a sealing material produced from a fluoropolymer resin or a fluoropolymer compound. In particular, the surface seal 178 may be formed from a polytetrafluoroethylene (PTFE) foil.

As may be seen from FIGS. 5 and 7, the surface seal 178 is provided with substantially rectangular through-openings 180, which in the mounted state of the surface seal 178 on the chamber drum 112 are each substantially coincident with a mouth opening 140 of a receiving chamber 126.

The through-openings 180 are consequently arranged in a regular grid, wherein the number of rows 182 situated one above the other corresponds to the number of chamber levels 128 of the treatment apparatus 100 and the number of columns 184 of the grid corresponds to the number of receiving chambers 126 per chamber level 128.

The through-openings 180 of the surface seals 178 are separated from one another by vertical webs 186 and by horizontal webs 188, wherein the horizontal webs 188 and the vertical webs 186 intersect in approximately square intersection regions 190.

In the mounted state of the surface seal 178, the horizontal webs 188 extend along the peripheral direction 187 of the chamber drum 112 and the vertical webs 186 extend along the axial direction 189 of the chamber drum 112.

Figure 6:
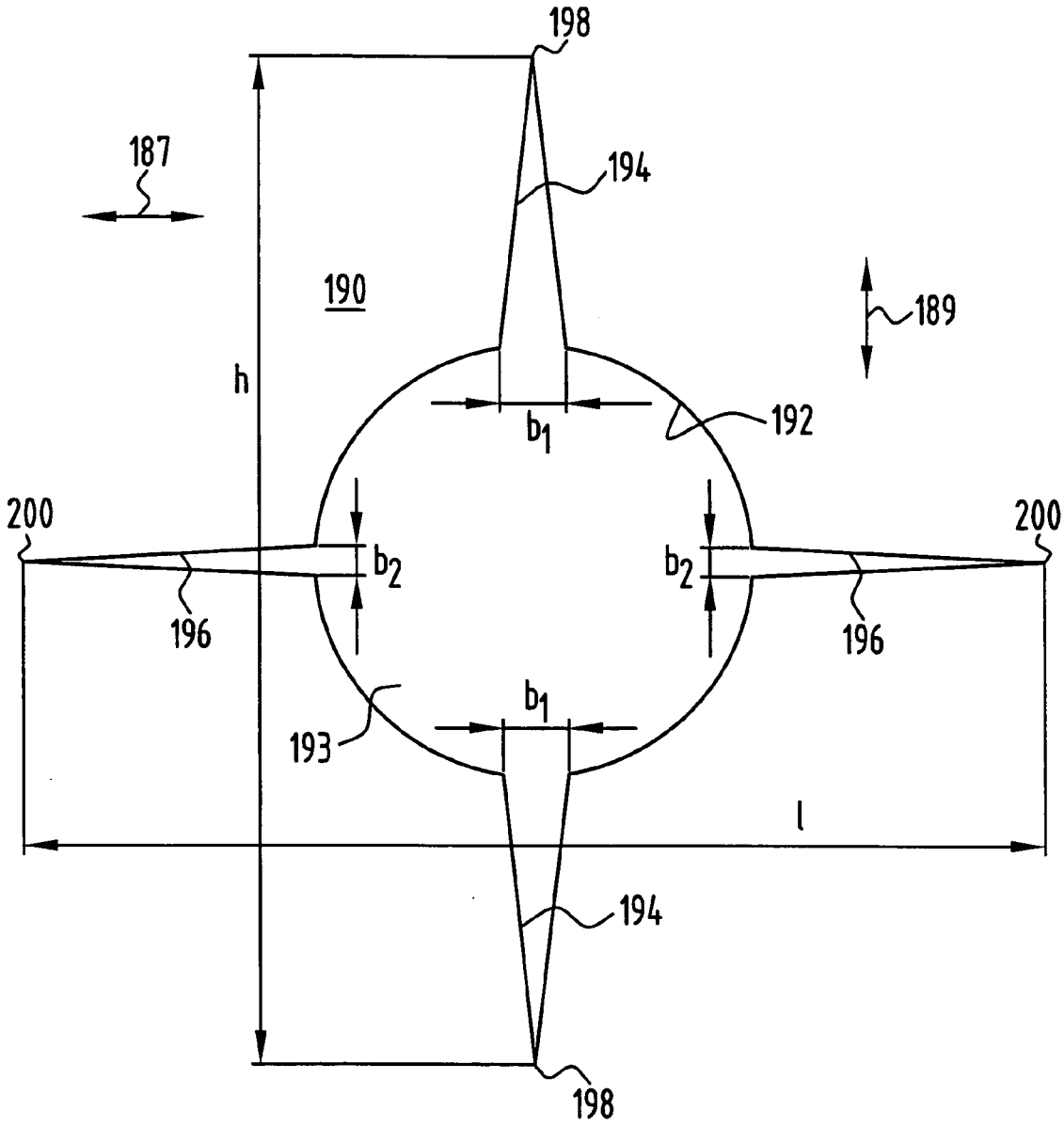
FIG. 6 a diagrammatic plan view of a compensating recess of the surface seal of FIG. 5, the compensating regions of which are widened in the cold mounted state.

As may best be seen from FIGS. 5 and 6, the surface seal 178 is provided in each intersection region 190 with a compensating recess 192, which comprises a substantially circular central region 193, from which two vertical compensating regions 194 in the form of vertical slots extend in an upward direction and in a downward direction and from which two horizontal compensating regions 196 in the form of horizontal slots extend to the left and to the right.

The through-openings 180 and the compensating recesses 192 are separated by a suitable separation method, e.g. by punching or cutting, from a substantially flat foil of the sealing material.

In a concrete embodiment, the thickness of the surface seal 178 is approximately 5 mm. The height of the chamber drum 112 and hence the height H of the surface seal 178 is, for example, approximately 1000 mm. The diameter of the chamber drum 112 is, for example, approximately 800 mm, so that the circumference of the chamber drum 112 and hence the length L of the surface seal 178 is approximately 2513 mm. In the embodiment, moreover, six chamber levels 128 and eight receiving chambers 126 per chamber level 128 are provided, so that the width of the vertical webs 186 and of the horizontal webs 188 is in each case approximately 30 mm.

The horizontal extent l and the vertical extent h of the compensating recesses 192 are preferably greater than the width of the vertical webs 186 and of the horizontal webs 188 respectively.

In a concrete embodiment, the vertical extent h of the compensating recesses 192 is, for example, approximately 40 mm. In the same embodiment, the horizontal extent l of the compensating recesses 192 is, for example, likewise approximately 40 mm.

The material of the surface seal 178 (e.g. PTFE or a PTFE compound) has a much higher coefficient of thermal expansion than the material of the chamber drum 112 (as a rule, a metal material, in particular a steel). In the course of warming from room temperature to an operating temperature of e.g. approximately 120° C., the surface seal 178 therefore expands by approximately 1% relative to the peripheral surface of the chamber drum 112, i.e. in the previously described concrete embodiment by approximately 25 mm in the peripheral direction of the chamber drum 112 and by approximately 10 mm in the axial direction of the chamber drum 112.

This difference in the thermal expansion of the surface seal 178, on the one hand, and of the chamber drum 112, on the other hand, is compensated by means of the compensating recesses 192 provided in the intersection regions 190 of the surface seal 178.

As is evident from FIGS. 5 and 6, in the mounted state (at room temperature) the surface seal 178 stretched onto the chamber drum 112 is under a mechanical prestressing, because of which the compensating regions 194, 196 of the compensating recesses 192 are widened.

In particular, the vertical compensating regions 194 from their point-shaped tip 198 to their point of opening into the central region of the compensating recess 192 widen to a width $b_1$ of e.g. approximately 3 mm. In the mounted state at room temperature, the horizontal compensating regions 196 in each case from their tip 200 to their point of opening into the central region 193 of the compensating recess 192 widen to a width $b_2$ of e.g. approximately 1.5 mm.

Figure 8:
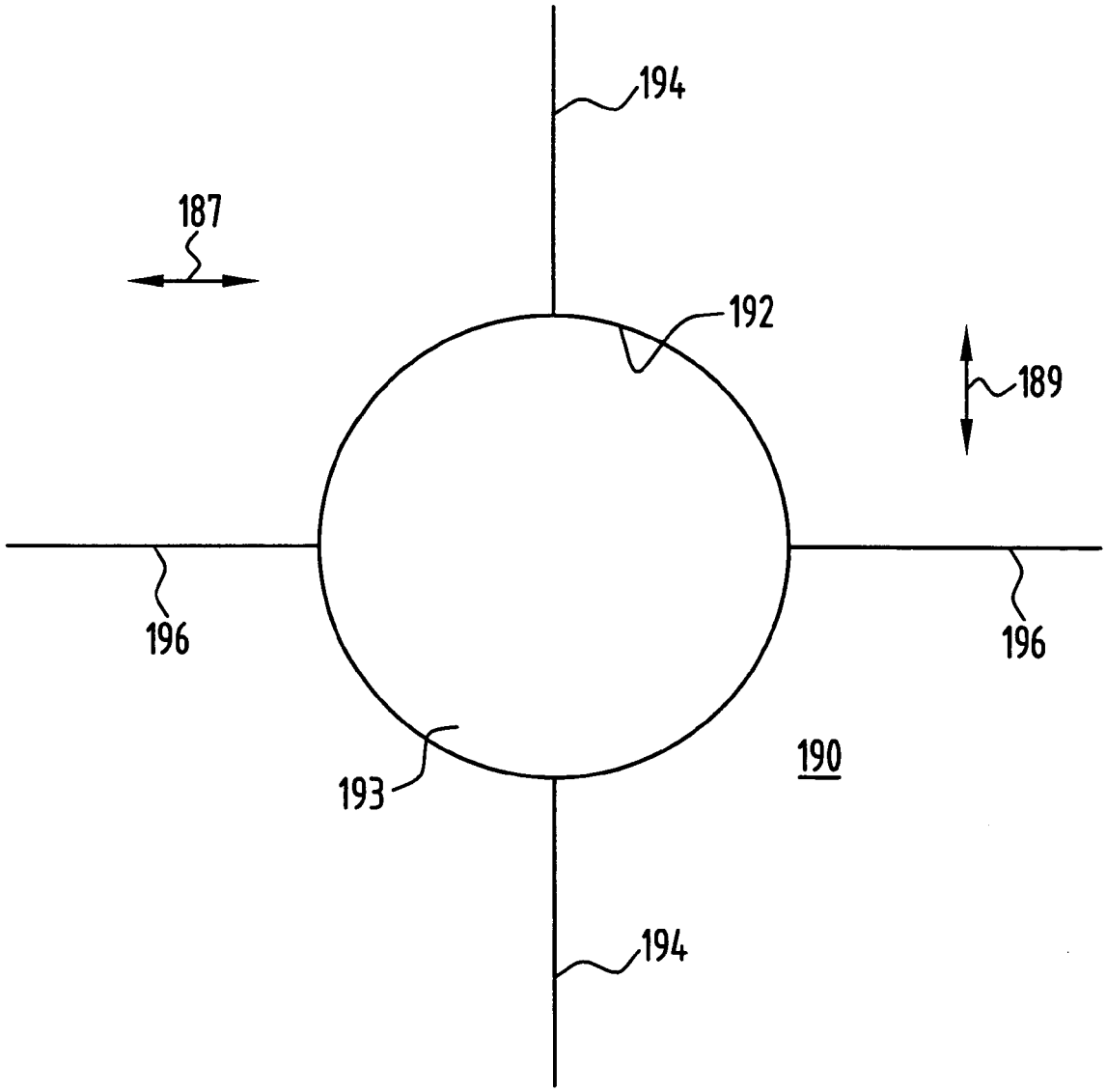
FIG. 8 a diagrammatic plan view of a compensating recess of the surface seal, the compensating regions of which are narrowed in the warm operating state.

By virtue of the greater thermal expansion of the surface seal 178 relative to the chamber drum 112 in the course of warming from room temperature to the operating temperature of e.g. approximately 120° C., the width of the vertical compensating regions 194 and of the horizontal compensating regions 196 decreases in the course of warming of the chamber drum 112 and of the surface seal 178 to the operating temperature until the width $b_1$ of the vertical compensating regions 194 and the width $b_2$ of the horizontal compensating regions 196 in the operating state is approximately equal to zero (see FIG. 8).

In the operating state, therefore, the surface seal 178 lies against the outside of the chamber drum 112 in a substantially stress-free manner, in particular without stresses acting in the peripheral direction 187 of the chamber drum 112 or in the axial direction 189 of the chamber drum 112. Thus, the surface seal 178 may be used in a wide operating temperature range without any risk of fatigue.

The surface seal 178 may easily be stretched onto the chamber drum 112 during manufacture of the treatment apparatus 100 or in the event of an exchange becoming necessary after a specific period of operation.

Figure 4:
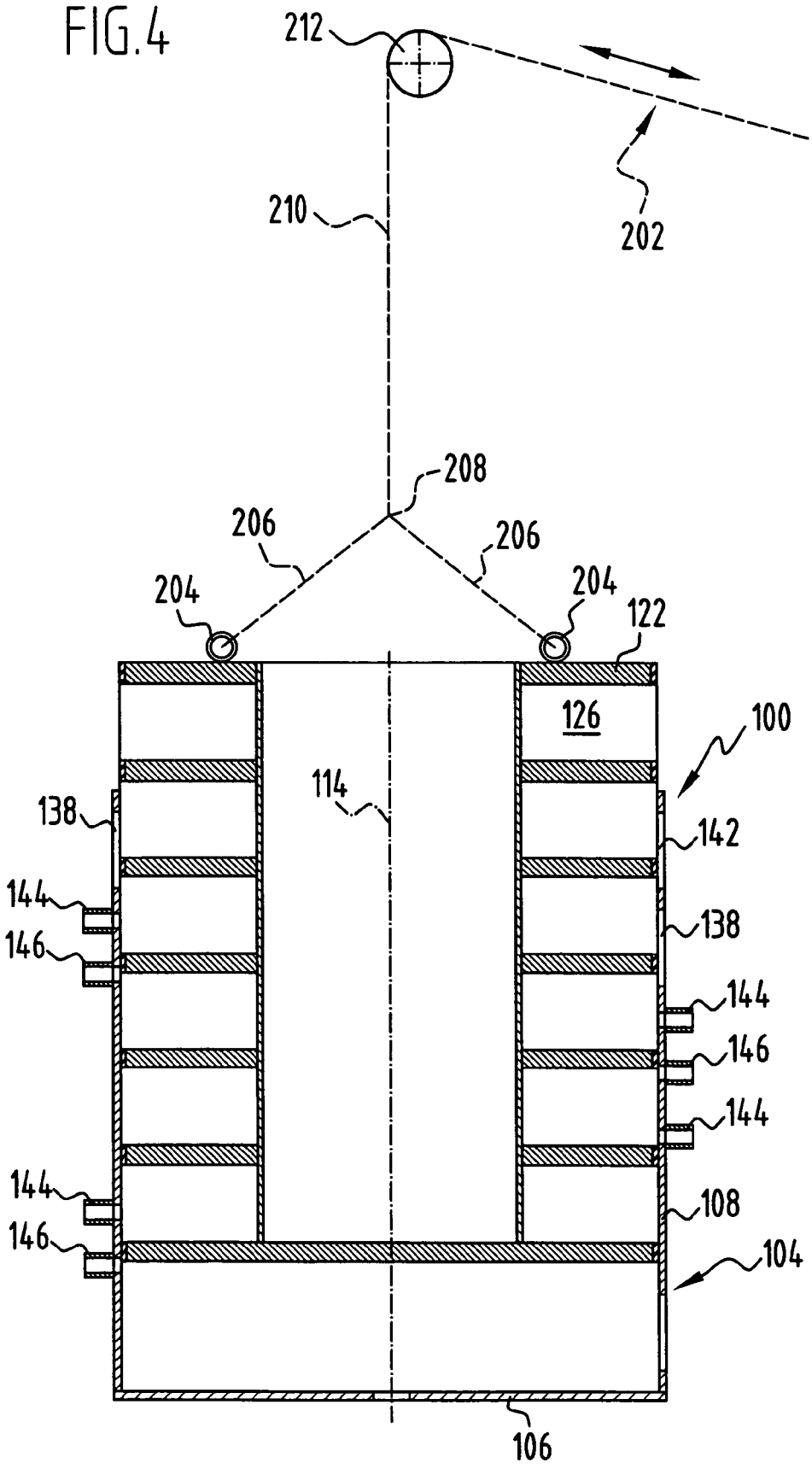
FIG. 4 a diagrammatic vertical longitudinal section through the treatment apparatus, wherein a chamber drum of the treatment apparatus is being lifted out of a housing of the treatment apparatus.

For this purpose, first the chamber drum 112 is lifted up out of the housing 104 of the treatment apparatus 100 in the manner shown in FIG. 4.

For this purpose, a lifting apparatus denoted as a whole by 202 may be used, which comprises a plurality of retaining rings 204, which are fastened to the upper side of the top plate 122 and through which in each case a holding rope 206 is drawn. The top ends of the holding ropes 206 are connected at the point 208 to a bottom end of a carrying rope 210, which is run via a stationary deflection pulley 212 and is liftable or lowerable by means of a motor-operated rope winch (not shown) in order to lift the chamber drum 112 out of the housing 104 or lower the chamber drum 112 again.

The surface seal 178 is designed in its dimensions to the warm operating state, i.e. designed in such a way that the vertical and horizontal slots of the compensating recesses 192 are closed in the warm operating state.

It is then possible in principle to lay out the surface seal 178 at the operating temperature onto the chamber drum 112. To do so, however, the chamber drum 112 and the surface seal 178 have to be heated up to the operating temperature outside of the housing 104 of the treatment apparatus 100, which—particularly in the case of the exchange of a surface seal 178 in the course of maintenance of the treatment apparatus 100—is either impossible or possible only with difficulty.

Alternatively, however, the surface seal 178 in the cold state may initially be laid loosely onto the cold chamber drum 112 and then extended successively in the peripheral direction 187 and in the axial direction 189 of the chamber drum 112.

Figure 9:
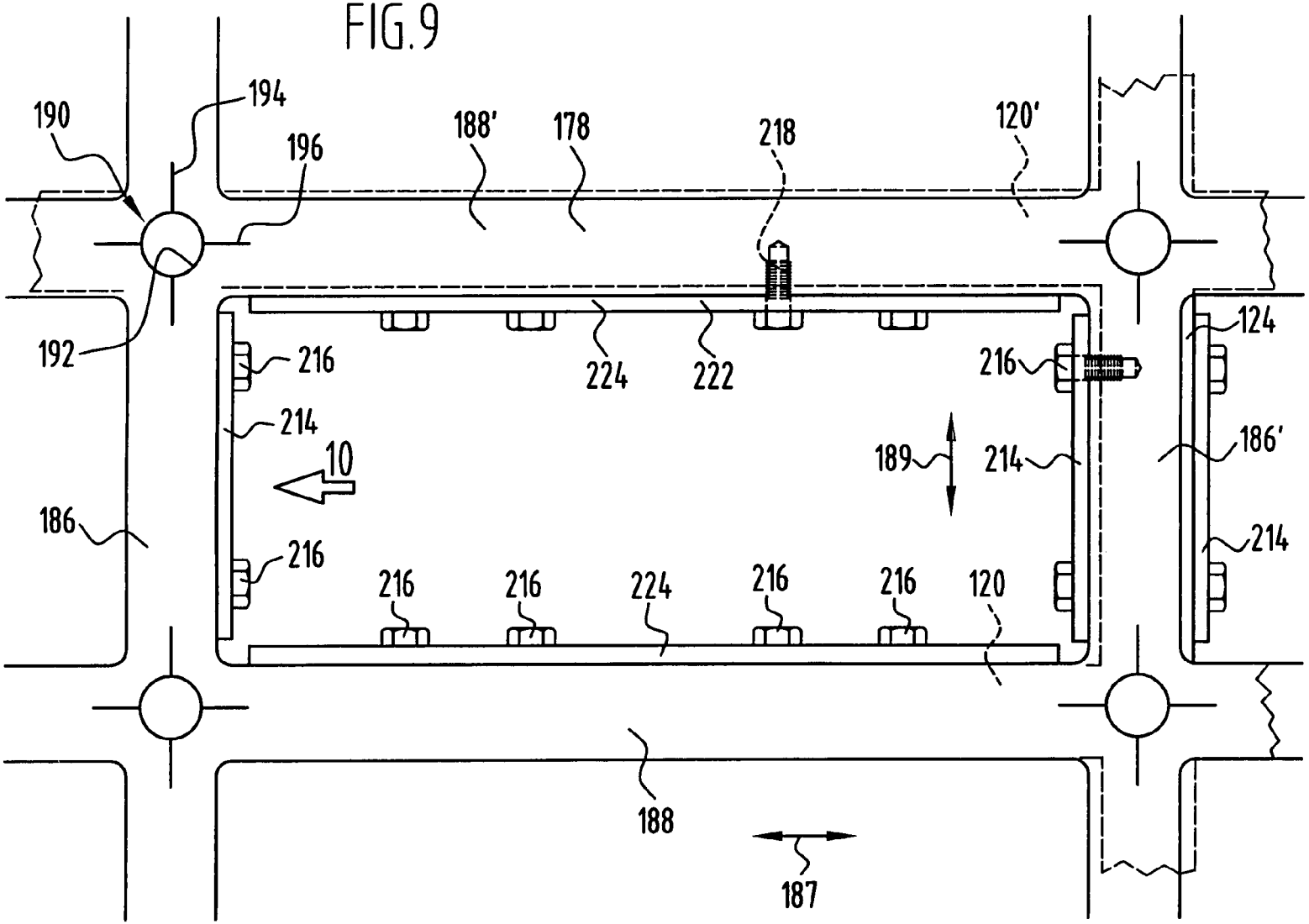
FIG. 9 a cutout-style diagrammatic plan view of the peripheral surface of a chamber drum of the treatment apparatus with a surface seal applied onto the chamber drum, before the surface seal has been extended by entrainment elements of the chamber drum.
Figure 10:
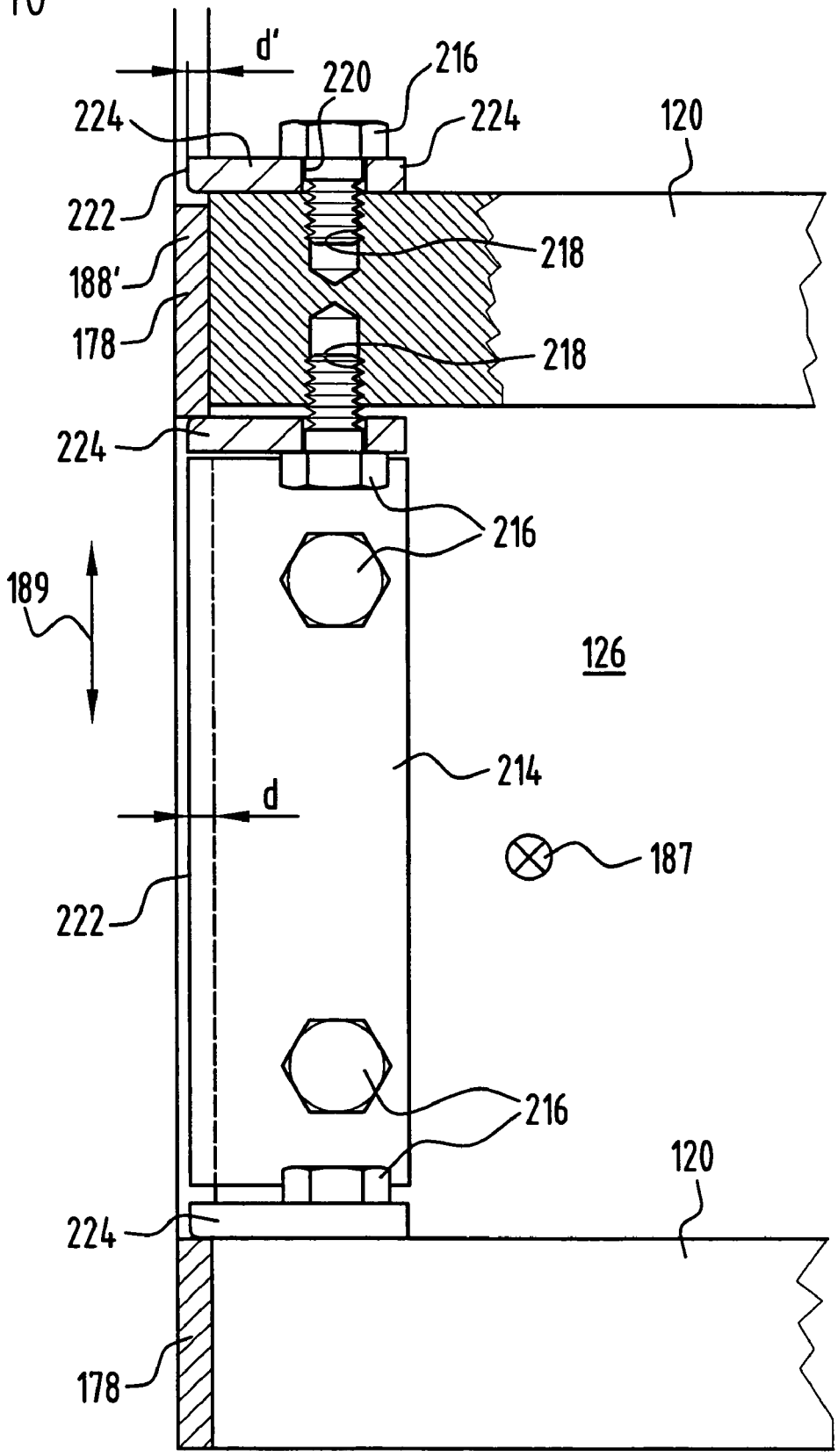
FIG. 10 a cutout-style diagrammatic radial section through an edge region of the chamber drum with the applied surface seal, before the surface seal has been extended by means of the entrainment elements, viewed in the direction of the arrow 10 in FIG. 9.

The extension of the surface seal 178 in the peripheral direction 187 of the chamber drum 112 is effected by means of vertical entrainment plates 214 (see FIG. 9), which are held by means of a plurality of—e.g. in each case two—fastening screws 216, which engage by their shanks into vertically mutually spaced threaded blind holes 218 and penetrate in each case a through-hole 220 in the vertical entrainment plate 214, on in each case one of the dividing walls 124 of the chamber drum 112, namely in the region of the mouth opening 140 of a receiving chamber 126, wherein an outer edge 222 of the respective entrainment plate 214 projects out in radial direction of the chamber drum 112 by a distance d, which is smaller than the thickness of the surface seal 178, e.g. by approximately 3 mm, beyond the relevant dividing wall 124 (see FIG. 10).

The requisite extension of the surface seal 178 in the axial direction 189 of the chamber drum 112 is effected by means of horizontal entrainment plates 224, which are held in each case by means of a plurality of—e.g. in each case four—fastening screws 216, which penetrate through-holes 220 in the horizontal entrainment plate 224 and are screwed into threaded blind holes 218 in the bottom wall or the top wall of a receiving chamber 126, on the relevant bottom wall or top wall of the receiving chamber 126, namely near the mouth opening 140 of the receiving chamber 126, wherein an outer edge 222 of the horizontal entrainment plate 224 projects out in radial direction of the chamber drum 112 by a distance d', which is smaller than the thickness of the surface seal 178, e.g. by approximately 3 mm, out beyond the relevant base plate 120, 116 and/or top plate 122 of the chamber drum 112.

At room temperature, the length L of the surface seal 178 is (e.g. 25 mm) shorter than the circumference of the chamber drum 112 and the height H of the surface seal 178 is (e.g. 10 mm) shorter than the height of the chamber drum 112.

In the cold pre-mounted state of the surface seal, in which the surface seal 178 is subject to no external stresses, the compensating regions 194, 196 of the compensating recesses 192 of the surface seal 178 are (just as in the warm operating state) closed.

For stretching the surface seal 178 onto the chamber drum 112, the surface seal 178 is initially placed with one of its vertical webs 186 onto a row of dividing walls 124 of the chamber drum 112, which are disposed one below the other, and is fastened at this web 186 by means of the vertical entrainment plates 214 adjacent thereto to the chamber drum 112 by fully tightening the fastening screws 216 of the relevant vertical entrainment plates 214 until the entrainment plates 214 lie flat against the relevant dividing wall 124.

The rest of the surface seal 178 is drawn initially only loosely round the chamber drum 112, with the result that a gap that is at least 25 mm wide remains between the ends of the surface seal 178.

Figure 11:
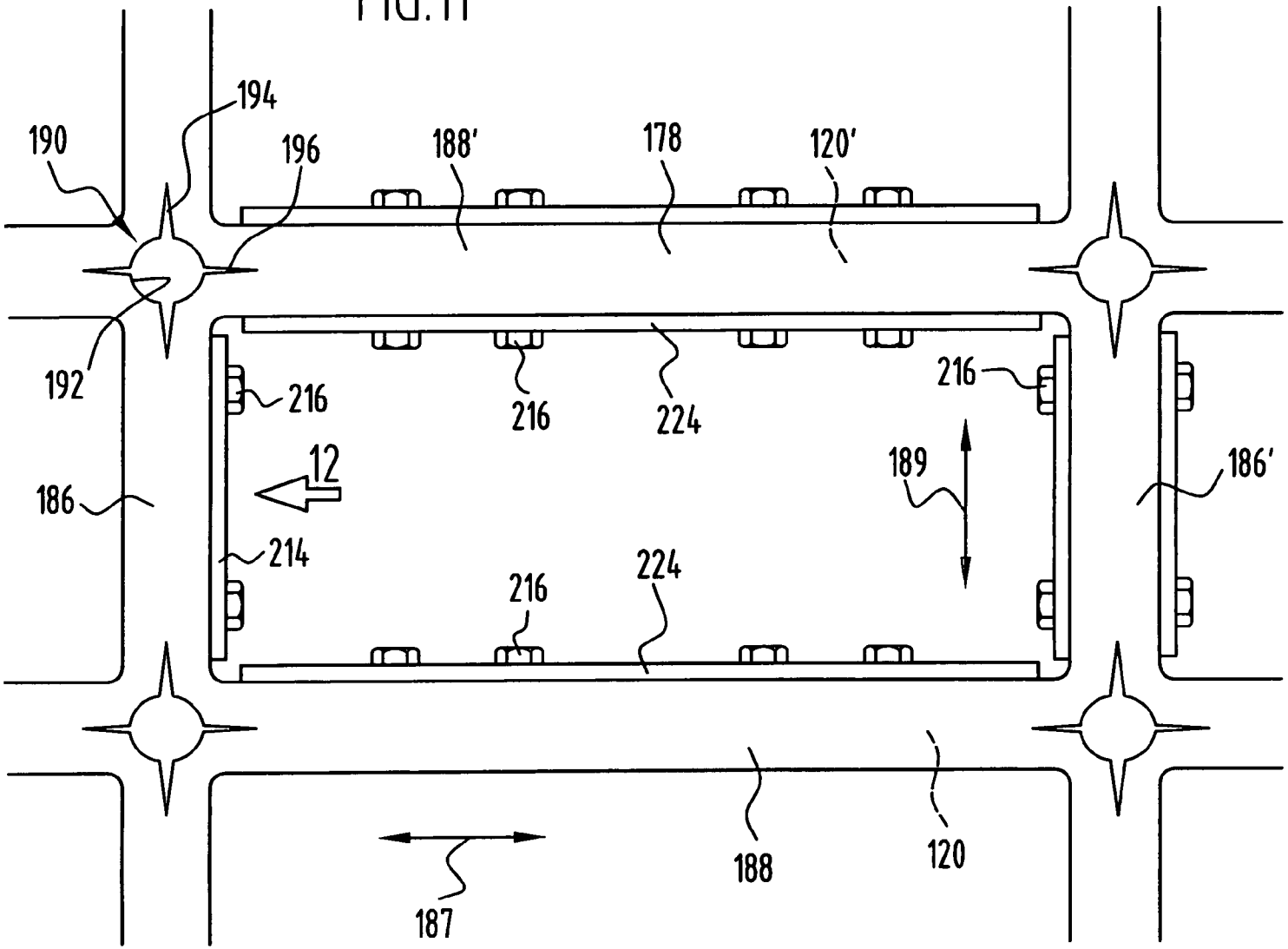
FIG. 11 a view as in FIG. 9, after the surface seal has been extended by means of the entrainment elements.
Figure 12:
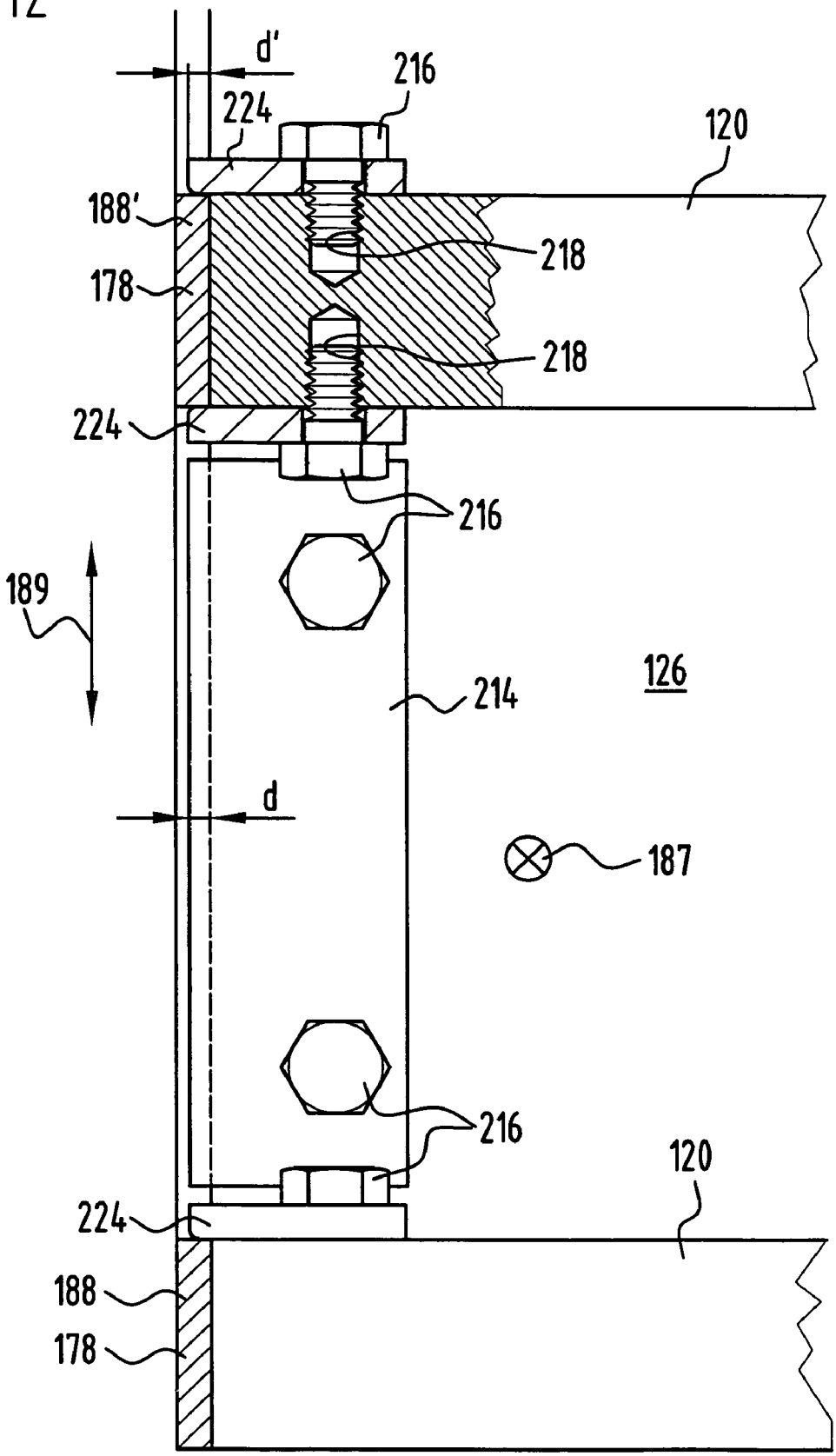
FIG. 12 a view as in FIG. 10, after the surface seal has been extended by means of the entrainment elements, viewed in the direction of the arrow 12 in FIG. 11.

Starting from the first vertical web 186, by which the surface seal 178 has been fastened to the chamber drum 112, the surface seal 178 at its—in the peripheral direction 187 of the chamber drum 112—adjacent vertical web 186' is extended by the anticipated thermal expansion by fully tightening (see FIG. 11) the fastening screws 216 of the vertical entrainment plates 214, which lie against the vertical web 186' and initially still project by approximately 4 mm from the relevant dividing wall 124 (see FIG. 9), until the respective associated vertical entrainment plates 214 lie flat against the relevant dividing wall 124. In said case, the surface seal 178 is pulled apart at the vertical compensating regions 194 of the compensating recesses 192 disposed in the webs 186 and is therefore extended in the peripheral direction 187 of the chamber drum 112.

As, in this case, only narrow web regions of the surface seal 178 that are situated alongside the vertical compensating regions 194 are slightly deformed, this extension of the surface seal 178 entails a much lower expenditure of force than would be the case if the whole vertical webs 186 in their overall width of e.g. approximately 30 mm had to be extended out of their material by the same amount (of e.g. approximately 3 mm).

In the same, previously described manner the surface seal 178 is fastened by its vertical webs, which succeed the vertical web 186' in the peripheral direction 187 of the chamber drum 112, to the chamber drum 112.

The surface seal 178 is then extended successively in the axial direction 189 of the chamber drum 112.

For this purpose, the surface seal 178 is fastened by a horizontal web 188 to a base plate 120 of the chamber drum 112 by fully tightening the fastening screws 216 of the adjacent horizontal entrainment plates 224 until the relevant horizontal entrainment plates 224 lie flat against the upper side and/or against the underside of the relevant base plate 120.

The surface seal 178 is then extended in the axial direction 189 of the chamber drum 112 in that a horizontal web 188', which is adjacent in vertical direction to the first horizontal web 188, is fastened to a vertically adjacent base plate 120', namely by fully tightening the fastening screws 216 of the horizontal entrainment plates 224 lying against the horizontal web 188' until these entrainment plates 224 also lie flat against the underside and/or against the upper side of the base plate 120'.

In said case, the surface seal 178 is pulled apart at the horizontal compensating regions 196 of the compensating recesses 192 disposed in the region of the horizontal web 188, with the result that the surface seal 178 is extended by the anticipated thermal expansion in the axial direction 189 of the chamber drum 112.

The extension of the surface seal 178 in the axial direction 189 is then continued in that the surface seal 178 is fastened by a further horizontal web, which follows the web 188' in the axial direction 189, to a further base plate 120 or to the top plate 122 or to the drum base plate 116 of the chamber drum 112.

Once all of the vertical webs 186 and all of the horizontal webs 188 of the surface seal 178 have been fastened by means of the entrainment plates 214, 224 to the chamber drum 112 and the surface seal 178 has therefore been fully spread onto the chamber drum 112, mounting of the surface seal 178 on the chamber drum 112 is complete.

The chamber drum 112 may then be re-inserted into the housing 104 of the treatment apparatus 100 by means of the lifting apparatus 202.

Figure 13:
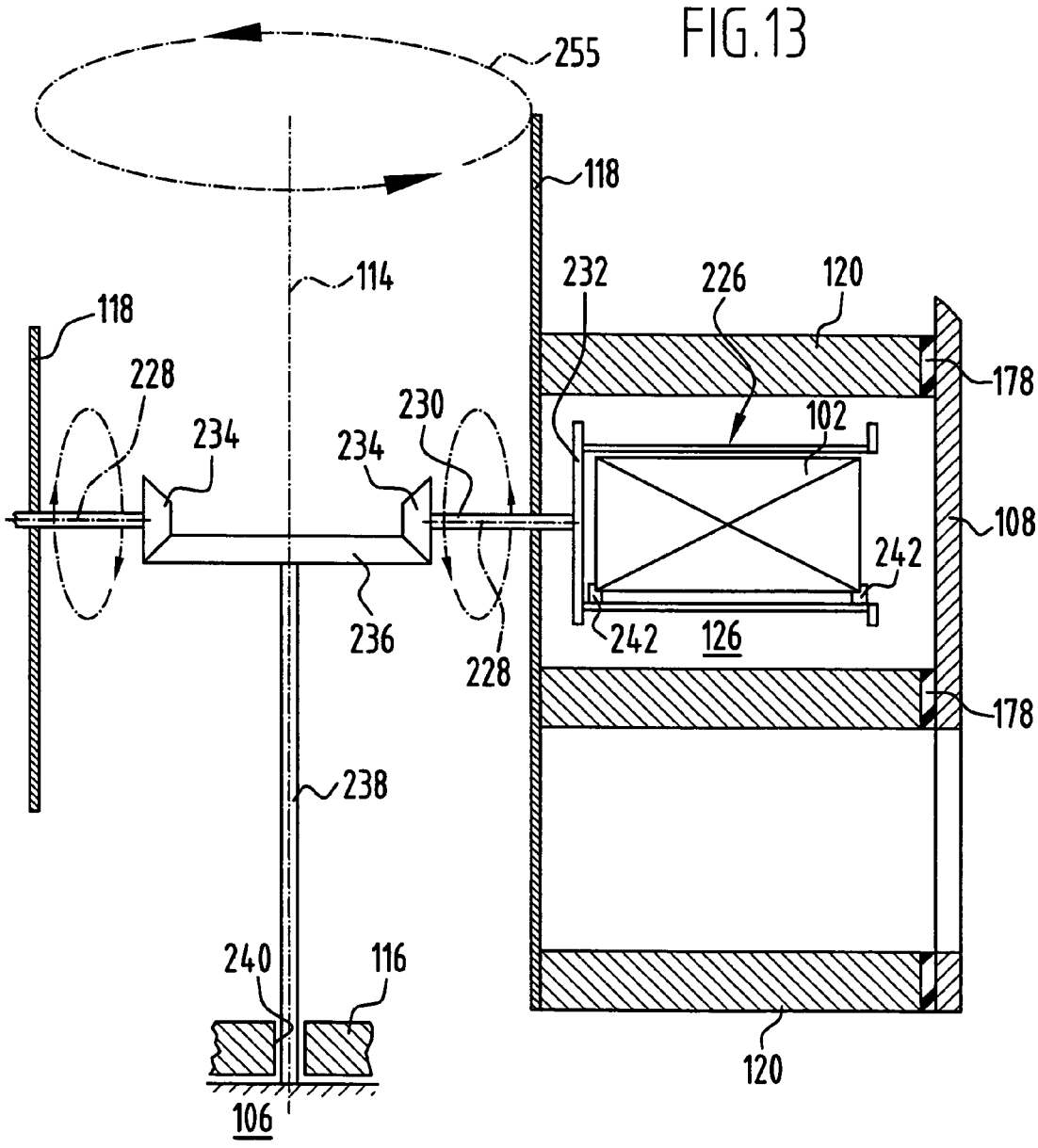
FIG. 13 a diagrammatic view of an apparatus for rotating a workpiece in a receiving chamber, wherein the turning apparatus comprises a drive shaft extending through a wall of the receiving chamber.

In a second embodiment of the treatment apparatus 100 illustrated in FIG. 13, the workpieces 102 passing through the treatment apparatus 100 are in at least one receiving chamber 126 not deposited onto stationary spacers 176 but received in a workpiece support 226, which is rotatable about an axis of rotation 228 that is aligned radially relative to the axis of rotation 114 of the chamber drum 112.

Rotation about the axis of rotation 228 is effected in said case by means of a rotary shaft 230, which is fastened to a radially inner end wall 232 of the workpiece support 226 and supported rotatably on the hollow shaft 118 of the chamber drum 112.

An end of the rotary shaft 230 situated inside the hollow shaft 118 is provided with a bevel gear 234, which is in mesh with a stationary central bevel gear 236, which is aligned coaxially with the axis of rotation 114 of the chamber drum 112 and connected to the upper side of the base plate 106 of the housing 104 of the treatment apparatus 100 by a vertical supporting tube 238, which penetrates a through-bore 240 in the drum base plate 116.

Consequently, upon a rotational movement of the hollow shaft 118 about the axis of rotation 114 of the chamber drum 112 the bevel gear 234, which is in mesh with the stationary central bevel gear 236, and hence the workpiece support 226 with the workpiece 102 accommodated therein rotate about the horizontal axis of rotation 228.

So that the workpiece 102 may be removed from the workpiece support 226 by means of a transfer apparatus 148, a plurality of spacers 242 are provided on the workpiece support 226 so that a movable workpiece receiver 158 of the transfer apparatus 148, e.g. a movable fork 160, may be moved into the space between the workpiece 102 and a wall of the workpiece support 226 in order to lift the workpiece 102 off the spacers 242 and move the workpiece 102 out of the workpiece support 226.

In order to uncouple the speed of rotation of the workpiece supports 226 in the receiving chambers 126 from the speed of rotation of the chamber drum 112 about the axis of rotation 114, it may also be provided that the central bevel gear 236, which is constructed coaxially with the axis of rotation 114, is not stationary but is supported rotatably relative to the housing 104 and comprises an independent rotary drive.

Otherwise, the second embodiment of a treatment apparatus 100 corresponds in construction and function to the first embodiment, to the above description of which reference is made in said regard.

Figure 14:
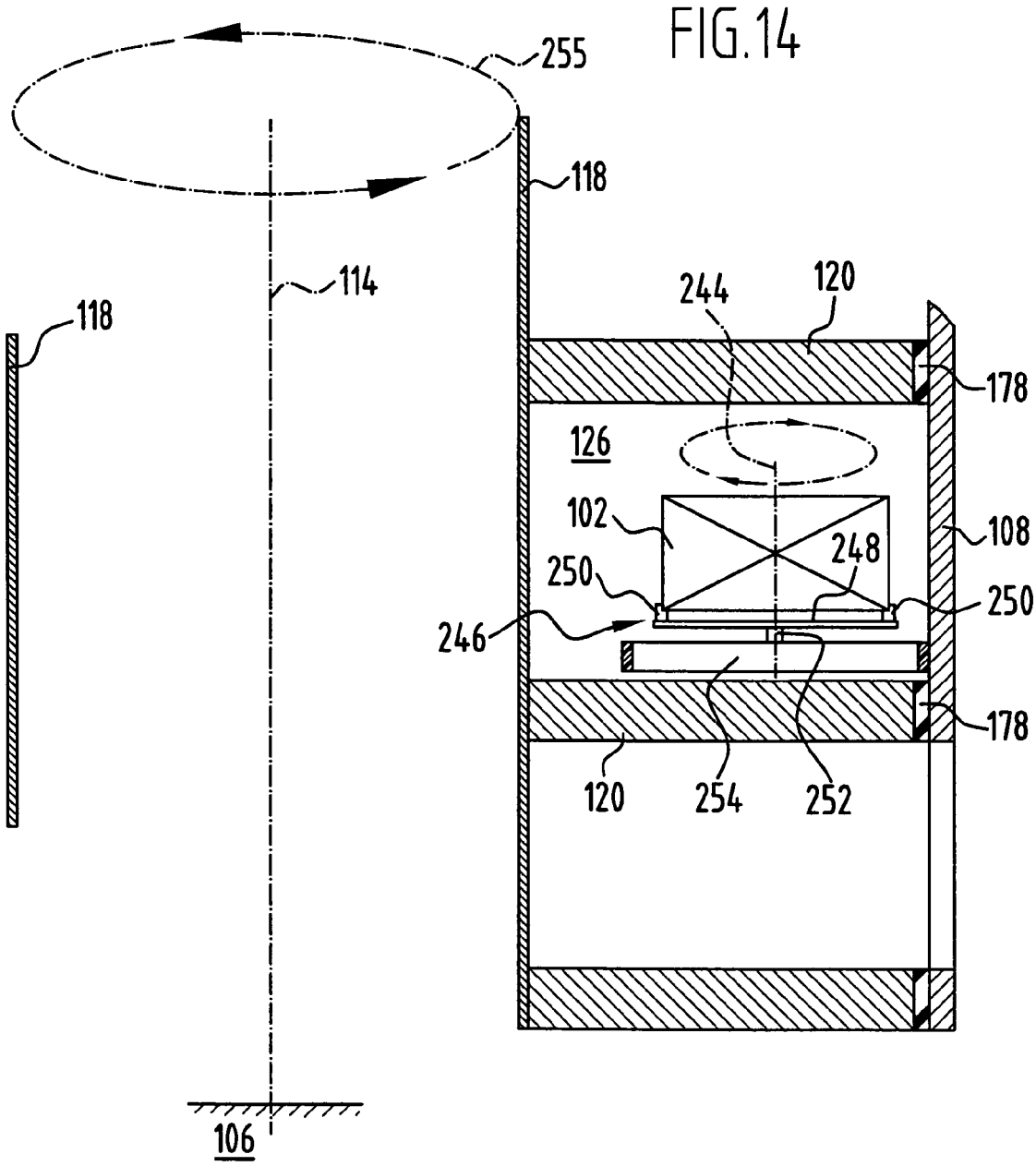
FIG. 14 a diagrammatic view of a turning apparatus for rotating a workpiece in a receiving chamber, wherein the turning apparatus is driven by means of frictional engagement with the housing of the treatment apparatus.

A third embodiment of a treatment apparatus 100 illustrated in FIG. 14 differs from the first embodiment in that the workpieces 102 in at least one receiving chamber 126 of the chamber drum 112 do not rest on stationary spacers 176 but are held in a workpiece support 246, which is rotatable about an axis of rotation 244 that is aligned parallel to the axis of rotation 114 of the chamber drum 112.

The workpiece support 246 comprises a rotating disk 248, on the upper side of which spacers 250 are disposed, on which the respective workpiece 102 rests.

The underside of the rotating disk 248 is connected by a rotary shaft 252, which is aligned coaxially with the axis of rotation 244 and supported (by means of non-illustrated bearings) rotatably on the base of the receiving chamber 126, to a friction wheel 254, the peripheral surface of which is in contact with the inner surface of the housing wall 108 of the housing 104 of the treatment apparatus 100.

Upon a rotational movement of the chamber drum 112 about the axis of rotation 114, the friction wheel 254, owing to the frictional engagement between the friction wheel 254 and the housing wall 108, rolls along the inner surface of the housing wall 108, with the result that the friction wheel 254 and hence the workpiece support 246 are set in rotation about the axis of rotation 244.

The spacers 250 of the workpiece support 246 allow a movable workpiece receiver 158 of the transfer apparatus 148 to be moved between the rotating disk 248 and the workpiece 102 in order to lift the workpiece 102 off the spacers 250 and then move the workpiece 102 out of the receiving chamber 126.

Otherwise, the third embodiment of a treatment apparatus 100 corresponds in construction and function to the first implementation function, to the above description of which reference is made in said regard.

Figure 15:
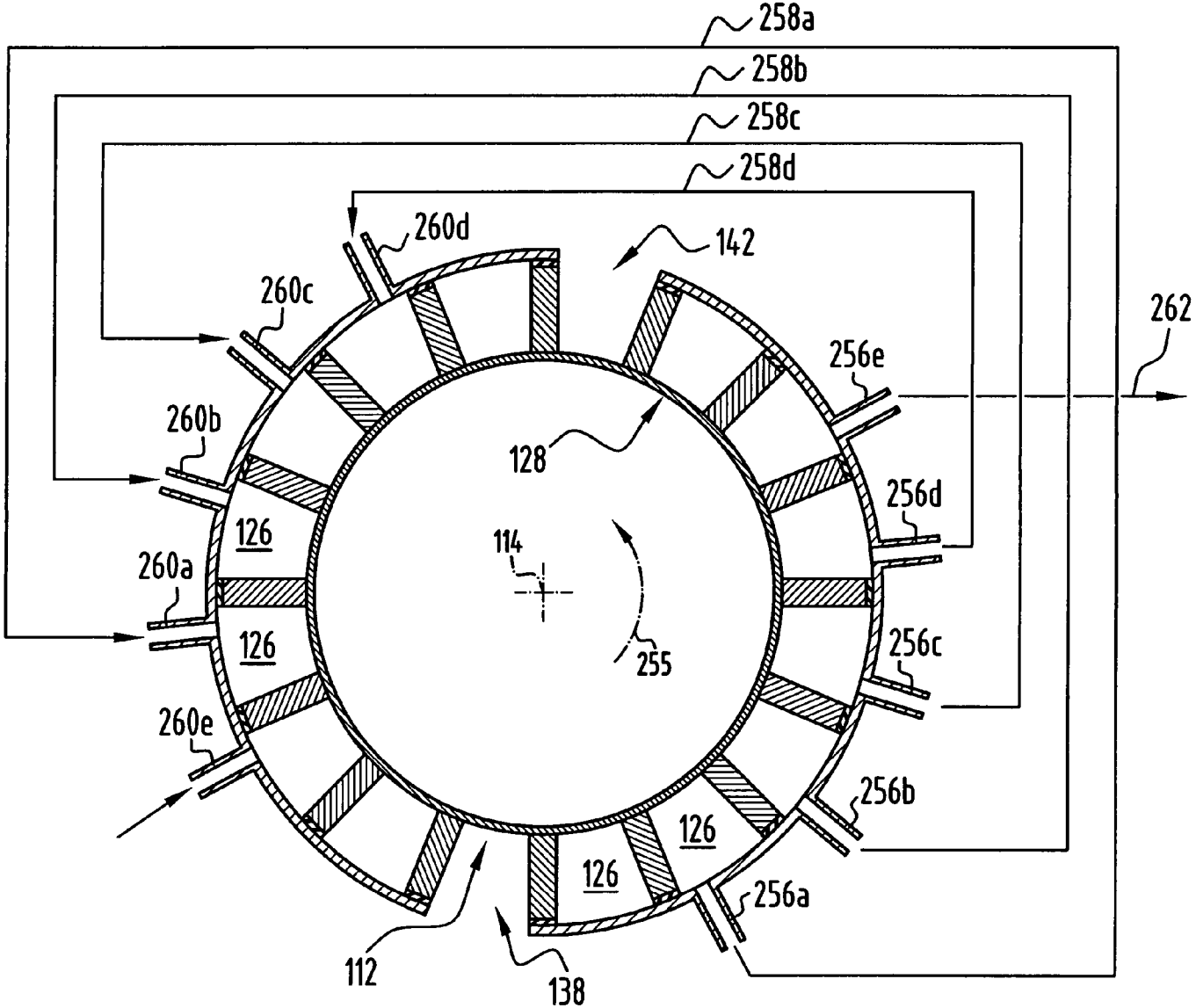
FIG. 15 a diagrammatic horizontal section through a chamber level of the treatment apparatus that is designed as a vacuum lock.

In a fourth embodiment of a treatment apparatus 100 illustrated in FIG. 15, at least one level of the treatment apparatus 100 has the function of a vacuum lock.

In the embodiment illustrated in FIG. 15, the relevant chamber level 128 is provided with sixteen receiving chambers 126, which because of the rotational movement of the chamber drum 112 about the axis of rotation 114 are moved from the inlet opening 138 of the chamber level 128, by which the chamber level 128 is in communication with the ambient atmosphere and through which the workpieces 102 are introduced into the chamber level 128, to the outlet opening 142 of the chamber level 128, which lies at an angular distance of 180° opposite the inlet opening 138 and at which the vacuum ultimate pressure of the chamber level 128 is reached and by which the chamber level 128 is connected to a following chamber level 128 that is likewise at least partially under vacuum.

Because of the rotational movement of the chamber drum 112, the receiving chambers 126—after removal of the workpieces 102 through the outlet opening 142—are returned in the empty state to the inlet opening 138.

On this level, each receiving chamber 126 therefore always travels from a region of high pressure (inlet opening 138) to a region having the vacuum ultimate pressure (outlet opening 142) and back again.

In the vacuum lock illustrated in FIG. 15, the vacuum is created in stages in that in each case an empty receiving chamber 126, in which there is still a vacuum, is connected in a gas short circuit to a receiving chamber, which contains a workpiece 102 and in which the vacuum ultimate pressure has not yet been reached.

For this purpose, the housing wall 108 in a region that (in the direction of rotation 255) follows the inlet opening 138 is provided with a first air discharge connecting piece 256*a*, which is connected by a first short-circuit line 258*a* to a first air feed connecting piece 260*a*, which is disposed on the housing wall 108 (viewed in the direction of rotation 255) after the outlet opening 142 and before the inlet opening 138.

A second air discharge connecting piece 256*b*, which is disposed (viewed in the direction of rotation 255) after the first air discharge connecting piece 256*a*, is connected by a second short-circuit line 258*b* to a second air feed connecting piece 260*b*, which is disposed (viewed in the direction of rotation 255) before the first air feed connecting piece 260*a*.

A third air discharge connecting piece 256*c*, which is disposed (viewed in the direction of rotation 255) after the second air discharge connecting piece 256*b*, is connected by a third short-circuit line 258*c* to a third air feed connecting piece 260*c*, which is disposed (viewed in the direction of rotation 255) before the second air feed connecting piece 260*b*.

A fourth air discharge connecting piece 256*d*, which is disposed (viewed in the direction of rotation 255) after the third air discharge connecting piece 256*c*, is connected by a fourth short-circuit line 258*d* to a fourth air feed connecting piece 260*d*, which is disposed (viewed in the direction of rotation 255) before the third air feed connecting piece 260*c*.

Disposed between the fourth air discharge connecting piece 256*d* and the outlet opening 142 of the chamber level 128 is a fifth air discharge connecting piece 256*e*, which is connected by a suction line 262 to a vacuum pump (not shown).

A fifth air feed connecting piece 260*e* disposed between the first air feed connecting piece 260*a* and the inlet opening 138 of the chamber level 128 opens into the ambient atmosphere, so that the receiving chamber 126 situated in each case in the region of the fifth air feed connecting piece 260*e* is aeratable through the fifth air feed connecting piece 260*e* up to atmospheric pressure.

In the previously described chamber level 128 used as a vacuum lock, therefore, a short circuit between a not yet fully evacuated receiving chamber 126, which is on the way from the inlet opening 138 to the outlet opening 142, and a not yet fully aerated receiving chamber 126, which is on the way from the outlet opening 142 back to the inlet opening 138, is effected altogether four times.

Assuming an atmospheric pressure of e.g. 1000 mbar and a desired vacuum ultimate pressure of e.g. 10 mbar, the chamber pressure after the pressure equalization through the first short-circuit line 258*a* is still e.g. approximately 800 mbar, after the pressure equalization through the second short-circuit line 258*b* still e.g. approximately 600 mbar, after the pressure equalization through the third short-circuit line 258*c* still e.g. approximately 400 mbar and after the pressure equalization through the fourth short-circuit line 258*d* still e.g. approximately 200 mbar.

The vacuum pump therefore has to evacuate the receiving chamber 126 situated in the region of the fifth air discharge connecting piece 256*e* only from approximately 200 mbar to the desired vacuum ultimate pressure of 10 mbar.

By virtue of the multi-stage evacuation, the vacuum pump therefore has to pump far less gas out of the receiving chambers 126.

Moreover, for the creation of the vacuum in a receiving chamber 126 a much longer period (given the use of 16 chambers in the chamber level 128 used as a vacuum lock, e.g. five times the workpiece progression cycle) is available for vacuum generation.

Furthermore, the pressure difference and hence the leakage rate through the surface seal 178 between receiving chambers 126 disposed successively in the peripheral direction 187 of the chamber drum 112 are also reduced by virtue of the multi-stage evacuation.

Otherwise, the fourth embodiment of a treatment apparatus 100 corresponds in construction and function to the first embodiment, to the previous description of which reference is made in said regard.

The invention claimed is:

1. Treatment apparatus for treating workpieces or groups of workpieces that are conveyed from an inlet to an outlet of the treatment apparatus, comprising a housing and receiving chambers, which rotate relative to the housing, for receiving the workpieces or groups of workpieces, wherein the receiving chambers are disposed in at least two different chamber levels and an outlet opening in the housing is associated with a first chamber level, through which the workpieces or groups of workpieces travel first, and an inlet opening is associated with a second chamber level, through which the workpieces or groups of workpieces travel after the first chamber level, and at least one transfer apparatus, which moves the workpieces or groups of workpieces from the outlet opening to the inlet opening, wherein the treatment apparatus comprises a chamber drum which is rotatable about an axis of rotation of the chamber drum and which is provided at its periphery with a surface seal moving together with the chamber drum, wherein the surface seal is in the form of a wrapping foil seal which is strctched onto the chamber drum.

2. Treatment apparatus according to claim 1, wherein the workpieces or groups of workpieces are movable by means of the transfer apparatus in a defined spatial position from the outlet opening to the inlet opening.

3. Treatment apparatus according to claim 1, wherein the workpieces or groups of workpieces in the first chamber level and/or in the second chamber level are moved through an angle of at least approximately 90°, preferably of at least approximately 180°, in particular of at least approximately 270°, about an axis of rotation of the treatment apparatus.

4. Treatment apparatus according to claim 1, wherein the workpieces or groups of workpieces in the first chamber level and/or in the second chamber level are moved through an angle of less than 360° about an axis of rotation of the treatment apparatus.

5. Treatment apparatus according to claim 1, wherein all of the receiving chambers of the same chamber level rotate synchronously with one another.

6. Treatment apparatus according to claim 5, wherein all of the receiving chambers of the same chamber level are rigidly connected to one another.

7. Treatment apparatus according to claim 1, wherein at least two receiving chambers of different chamber levels rotate synchronously with one another.

8. Treatment apparatus according to claim 7, wherein at least two receiving chambers of different chamber levels are rigidly connected to one another.

9. Treatment apparatus according to claim 1, wherein all of the receiving chambers of all of the chamber levels rotate synchronously with one another.

10. Treatment apparatus according to claim 9, wherein all of the receiving chambers of all of the chamber levels are rigidly connected to one another.

11. Treatment apparatus according to claim 1, wherein the treatment apparatus comprises at least one bottom wall, which is oriented transversely of the axis of rotation, and at least two dividing walls, which are oriented transversely of the bottom wall.

12. Treatment apparatus according to claim 11, wherein the chamber drum comprises at least two bottom walls and at least one top wall, which is oriented transversely of the axis of rotation.

13. Treatment apparatus according to claim 1, wherein the material of the surface seal comprises a plastics material of low sliding friction, preferably a fluoropolymer or a fluoropolymer compound.

14. Treatment apparatus according to claim 1, wherein the surface seal is provided with compensating recesses, wherein the compensating recesses comprise in each case at least one compensating region, which varies in width upon a temperature change of the surface seal and/or upon loading of the surface seal with a mechanical stress.

15. Treatment apparatus according to claim 14, wherein at least some of the compensating recesses comprise in each case at least one compensating region, which has a longitudinal direction oriented transversely of, preferably substantially at right angles to, the peripheral direction of the chamber drum.

16. Treatment apparatus according to claim 14, wherein at least some of the compensating recesses comprise in each case at least one compensating region, which has a longitudinal direction oriented substantially parallel to the peripheral direction of the chamber drum.

17. Treatment apparatus according to claim 14, wherein at least some of the compensating recesses comprise in each case at least two compensating regions.

18. Treatment apparatus according to claim 17, wherein at least some of the compensating recesses comprise in each case at least two compensating regions, which have longitudinal directions oriented transversely of, preferably substantially at right angles to, one another.

19. Treatment apparatus according to claim 14, wherein the compensating recesses comprise in each case at least one compensating region, which in the mounted state of the surface seal varies in width upon a change of the temperature of the surface seal in such a way that the difference between the thermal expansion of the surface seal and of the chamber drum is at least partially, preferably substantially fully, compensated.

20. Treatment apparatus according to claim 14, wherein at least some of the compensating recesses comprise in each case a central region, into which at least two compensating regions open.

21. Treatment apparatus according to claim 20, wherein at least some of the compensating recesses comprise a central region, into which at least two compensating regions open, which have longitudinal directions oriented transversely of, preferably substantially at right angles to, one another.

22. Treatment apparatus according to claim 14, wherein the surface seal in addition to the compensating recesses has access openings, which in the mounted state of the surface seal afford access to receiving chambers of the chamber drum.

23. Treatment apparatus according to claim 22, wherein the surface seal comprises webs, which separate the access openings from one another, and wherein at least some of the compensating recesses are disposed in intersection regions of the webs.

24. Treatment apparatus according to claim 1, wherein the surface seal in the mounted state encircles the chamber drum.

25. Treatment apparatus according to claim 1, wherein the surface seal is of an integral construction.

26. Treatment apparatus according to claim 1, wherein the receiving chambers are removable from the housing.

27. Treatment apparatus according to claim 26, wherein a plurality of receiving chambers form component parts of a chamber drum, which is removable as a whole from the housing.

28. Treatment apparatus according to claim 1, wherein at least one of the receiving chambers is provided with a workpiece support, by means of which the workpiece inside the receiving chamber is rotatable relative to the receiving chamber.

29. Treatment apparatus according to claim 28, wherein the workpiece is rotatable by means of the workpiece support about an axis of rotation that is aligned substantially parallel to the axis of rotation of the receiving chambers of the treatment apparatus.

30. Treatment apparatus according to claim 28, wherein the workpiece is rotatable by means of the workpiece support about an axis of rotation that is oriented transversely of, preferably substantially at right angles to, the axis of rotation of the receiving chambers of the treatment apparatus.

31. Treatment apparatus according to claim 1, wherein at least one of the receiving chambers is provided with a turning apparatus, which comprises means of picking off a rotational movement from an inner wall of the housing of the treatment apparatus.

32. Treatment apparatus according to claim 1, wherein at least one of the receiving chambers is provided with a turning apparatus, which comprises a rotary shaft extending through a wall of the receiving chamber.

33. Treatment apparatus according to claim 1, wherein at least one chamber level of the treatment apparatus is designed as a vacuum lock.

34. Treatment apparatus according to claim 33, wherein the receiving chambers of the chamber level designed as a vacuum lock in the course of their movement from an inlet opening of said chamber level to an outlet opening of said chamber level are evacuated in a plurality of discrete stages.

35. Treatment apparatus according to claim 33, wherein the receiving chambers of the chamber level designed as a vacuum lock in the course of their movement from an outlet opening of said chamber level to an inlet opening of said chamber level are aerated in a plurality of discrete stages.

36. Treatment apparatus according to claim 33, wherein in each case at least one of the receiving chambers of the chamber level designed as a vacuum lock that is on the way from the inlet opening of said chamber level to the outlet opening of said chamber level is connected in terms of gas with in each case one other receiving chamber of said chamber level that is on the way from the outlet opening of said chamber level to the inlet opening of said chamber level.

37. Treatment apparatus for treating workpieces or groups of workpieces that are conveyed from an inlet to an outlet of the treatment apparatus, comprising a housing and receiving chambers, which rotate relative to the housing, for receiving the workpieces or groups of workpieces, wherein the receiving chambers are disposed in at least two different chamber levels and an outlet opening in the housing is associated with a first chamber level, through which the workpieces or groups of workpieces travel first, and an inlet opening is associated wit a second chamber level, through which the workpieces or groups of workpieces travel after the first chamber level, and at least one transfer apparatus, which moves the workpieces or groups of workpieces from the outlet opening to the inlet opening, wherein the receiving chambers are removable from the housing.

38. Treatment apparatus for treating workpieces or groups of workpieces that are conveyed from an inlet to an outlet of the treatment apparatus, comprising a housing and receiving chambers, which rotate relative to the housing, for receiving the workpieces or groups of workpieces, wherein the receiving chambers are disposed in at least two different chamber levels and an outlet opening in the housing is associated wit a first chamber level, through which the workpieces or groups of workpieccs travel first, and an inlet opening is associated with a second chamber level, through which the workpieces or groups of workpieces travel after the first chamber level, and at least one transfer apparatus, which moves the workpieces or groups of workpieces from the outlet opening to the inlet opening, wherein at least one of the receiving chambers is provided with a workpiece support, by means of which the workpiece inside the receiving chamber is rotatable relative to the receiving chamber.

39. Treatment apparatus for treating workpieces or groups of workpieces that are conveyed from an inlet to an outlet of the treatment apparatus, comprising a housing and receiving chambers, which rotate relative to the housing, for receiving the workpieces or groups of workpieces, wherein the receiving chambers are disposed in at least two different chamber levels and an outlet opening in the housing is associated with a first chamber level, through which the workpieces or groups of workpieces travel first, and an inlet opening is associated with a second chamber level, through which the workpieces or groups of workpieces travel after the first chamber level, and at least one transfer apparatus, which moves the workpieces or groups of workpieces from the outlet opening to the inlet opening, wherein at least one of the receiving chambers is provided with a turning apparatus, which comprises means of picking off a rotational movement from an inner wall of the housing of the treatment apparatus.

40. Treatment apparatus for treating workpieces or groups of workpieces that are conveyed from an inlet to an outlet of the treatment apparatus, comprising a housing and receiving chambers, which rotate relative to the housing, for receiving the workpieces or groups of workpieces, wherein the receiving chambers are disposed in at least two different chamber levels and an outlet opening in the housing is associated with a first chamber level, through which the workpieces or groups of workpieces travel first, and an inlet opening is associated with a second chamber level, through which the workpieces or groups of workpieces travel after the first chamber level, and at least one transfer apparatus, which moves the workpieces or groups of workpieces from the outlet opening to the inlet opening, wherein at least one of the receiving chambers is provided with a turning apparatus, which comprises a rotary shaft extending through a wall of the receiving chamber.

41. Treatment apparatus for treating workpieces or groups of workpieces tat are conveyed from an inlet to an outlet of the treatment apparatus, comprising a housing and receiving chambers, which rotate relative to the housing, for receiving the workpieces or groups of workpieces, wherein the receiving chambers are disposed in at least two different chamber levels and an outlet opening in the housing is associated with a first chamber level, through which the workpieces or groups of workpieces travel first, and an inlet opening is associated with a second chamber level, through which the workpieces or groups of workpieces travel after the first chamber level, and at least one transfer apparatus, which moves the workpieces or groups of workpieces from the outlet opening to the inlet opening, wherein at least one chamber level of the treatment apparatus is designed as a vacuum lock.

42. Treatment apparatus according to claim 41, wherein the receiving chambers of the chamber level designed as a vacuum lock in the course of their movement from an inlet opening of said chamber level to an outlet opening of said chamber level are evacuated in a plurality of discrete stages.

43. Treatment apparatus according to claim 41, wherein the receiving chambers of the chamber level designed as a vacuum lock in the course of their movement from an outlet opening of said chamber level to an inlet opening of said chamber level are aerated in a plurality of discrete stages.

44. Treatment apparatus according to claim 41, wherein in each case at least One of the receiving chambers of the chamber level designed as a vacuum lock that is on the way from the inlet opening of said chamber level to the outlet opening of said chamber level is connected in terms of gas with in each case one other receiving chaniber of said chamber level that is on the way from the outlet opening of said chamber level to the inlet opening of said chamber level.

45. Treatment apparatus for treating workpieces or groups of workpieces that are conveyed from an inlet to an outlet of the treatment apparatus, comprising a housing and receiving chambers, which rotate relative to the housing, for receiving the workpieces or groups of workpieces, wherein the receiving chambers are disposed in at least two different chamber levels and an outlet opening in the housing is associated with a first chamber level, through which the workpieces or groups of workpieces travel first, and an inlet opening is associated with a second chamber level, through which the workpieces or groups of workpieces travel after the first chamber level, and at least one transfer apparatus, which moves the workpieces or groups of workpieces from the outlet opening to the inlet opening, wherein the treatment apparatus comprises a chamber drum which is rotatable about an axis of rotation of the chamber drum and which is provided at its periphery with a surface seal moving together with the chamber drum, wherein the material of the surface seal comprises a fluoropolymer or a fluoropolymer compound.

46. Treatment apparatus for treating workpieccs or groups of workpieces that are conveyed from an inlet to an outlet of the treatment apparatus, comprising a housing and receiving chambers, which rotate relative to the housing, for receiving the workpieces or groups of workpicces, wherein the receiving chambers are disposed in at least two different chamber levels and an outlet opening in the housing is associated with a first chamber level, through which the workpieces or groups of workpieces travel first, and an inlet opening is associated with a second chamber level, through which the workpieces or groups of workpieces travel after the first chamber level, and at least one transfer apparatus, which moves the workpieces or groups of workpieces from the outlet opening to the inlet opening, wherein the treatment apparalus comprises a chamber drum which is provided at its periphery with a surface seal, wherein the surface seal is provided with compensating recesses, wherein the compensating recesses comprise in each case at least one compensating region, which varies in width upon a temperature change of the surface seal and/or upon loading of the surface seal with a mechanical stress.

47. Treatment apparatus for treating workpieces or groups of workpieces that are conveyed from an inlet to an outlet of the treatment apparatus, comprising a housing and receiving chambers, which rotate relative to the housing, for receiving the workpieces or groups of workpieces, wherein the receiving chambers are disposed in at least two different chamber levels and an outlet opening in the housing is associated with a first chamber level, through which the workpieces or groups of workpieces travel first, and an inlet opening is associated with a second chamber level, through which the workpieces or groups of workpieces travel after the first chamber level, and at least one transfer apparatus, which moves the workpieces or groups of workpieces from the outlet opening to the inlet opening, wherein the treatment apparatus comprises a chamber drum which is provided at its periphery with a surface seal, and wherein the receiving chambers are removable from the housing.

* * * * *

UNITED STATES PATENT AND TRADEMARK OFFICE

CERTIFICATE OF CORRECTION

PATENT NO. : 7,210,990 B2
APPLICATION NO. : 11/092458
DATED : May 1, 2007
INVENTOR(S) : Buchman et al.

It is certified that error appears in the above-identified patent and that said Letters Patent is hereby corrected as shown below:

IN THE CLAIMS:

In claim 1, column, 17, line 59, “strctched” should read --stretched--

In claim 37, column 20, line 26, “wit” should read --with--

In claim 38, column 20, line 38, “wit” should read --with--

In claim 41, column 21, line 19, “tat” should read --that--

In claim 44, column 21, line 45, “One” should read --one--

In claim 44, column 21, line 49, “chaniber” should read --chamber--

In claim 46, column 22, line 19, “workpicces” should read --workpieces--

Signed and Sealed this

Twenty-first Day of August, 2007

JON W. DUDAS
*Director of the United States Patent and Trademark Office*